US012637244B2

(12) United States Patent
Wimmer et al.

(10) Patent No.: US 12,637,244 B2
(45) Date of Patent: May 26, 2026

(54) METHOD AND PACKAGING DEVICE FOR PRODUCING PACKAGING UNITS, AND APPLICATION HEAD FOR CORRESPONDING USE

(71) Applicant: Krones Aktiengesellschaft, Neutraubling (DE)

(72) Inventors: Thomas Wimmer, Rosenheim (DE); Marcus Kreis, Kolbermoor (DE); Herbert Spindler, Niedermoosen (DE)

(73) Assignee: Krones Aktiengesellschaft, Neutraubling (DE)

( * ) Notice: Subject to any disclaimer, the term of this patent is extended or adjusted under 35 U.S.C. 154(b) by 0 days.

(21) Appl. No.: 18/876,885

(22) PCT Filed: Apr. 26, 2023

(86) PCT No.: PCT/EP2023/060963
§ 371 (c)(1),
(2) Date: Dec. 19, 2024

(87) PCT Pub. No.: WO2023/247095
PCT Pub. Date: Dec. 28, 2023

(65) Prior Publication Data

US 2025/0368367 A1 Dec. 4, 2025

(30) Foreign Application Priority Data

Jun. 21, 2022 (DE) ..... 10 2022 115 413.0

(51) Int. Cl.
*B65B 17/02* (2006.01)
*B65B 27/04* (2006.01)

(52) U.S. Cl.
CPC ..... *B65B 17/025* (2013.01); *B65B 27/04* (2013.01)

(58) Field of Classification Search
CPC ..... B65B 17/025; B65B 27/04; B65B 7/285
See application file for complete search history.

(56) References Cited

U.S. PATENT DOCUMENTS 3,627,309 A * 12/1971 Ganz ..... B65B 21/24 271/22
5,233,811 A * 8/1993 Odum ..... B65B 17/025 53/556

(Continued)

FOREIGN PATENT DOCUMENTS

DE 102019133468 A1 6/2021
EP 1075419 A1 2/2001

(Continued)

OTHER PUBLICATIONS

PCT Application: PCT/EP2023/060963 Filed Apr. 26, 2023—International Search Report and Written Opinion dated Sep. 21, 2023.

(Continued)

*Primary Examiner* — Thomas M Wittenschlaeger
(74) *Attorney, Agent, or Firm* — Simmons Perrine PLC

(57) ABSTRACT

A method and a packaging apparatus for producing packaging units as well as an application head (60) for use in the method or in the packaging apparatus are disclosed. In the method, a flat packaging blank (14) is transferred, by an application head (60) to an article grouping (20) held ready, to be applied there to an upper end face of the article grouping (20), producing a mechanical connection between the packaging blank (14) and the article grouping (20). Foldable portions (24) of the packaging blank (14) that project beyond an upper side of the article grouping (20) are then folded over and are applied to the article grouping (20) laterally. The packaging apparatus is equipped with at least one such application head (60).

17 Claims, 8 Drawing Sheets

(56) References Cited

U.S. PATENT DOCUMENTS

| | | | | |
|---|---|---|---|---|
| 5,775,486 | A | 7/1998 | Edqvist | |
| 6,508,047 | B1 * | 1/2003 | Groppi | B65B 17/025 294/87.2 |
| 11,511,895 | B1 * | 11/2022 | L'Heureux | B65B 57/16 |
| 11,897,639 | B2 * | 2/2024 | Serpa | B65B 27/04 |
| 11,905,050 | B2 * | 2/2024 | Elliott | B65B 17/025 |
| 12,304,674 | B2 * | 5/2025 | Luber | B65B 35/30 |
| 2009/0090085 | A1 * | 4/2009 | Marco | B65B 21/24 206/139 |
| 2009/0308763 | A1 | 12/2009 | Oster | |
| 2010/0022373 | A1 * | 1/2010 | LeBras | B65D 71/007 493/52 |
| 2011/0016831 | A1 * | 1/2011 | Huber | B65B 21/06 53/448 |
| 2011/0030311 | A1 * | 2/2011 | Martini | B65B 43/185 53/154 |
| 2020/0361645 | A1 * | 11/2020 | Spindler | B65B 35/30 |
| 2021/0261279 | A1 * | 8/2021 | Zacherle | B65B 35/30 |
| 2022/0348368 | A1 * | 11/2022 | Frederick | B65B 17/025 |
| 2024/0253883 | A1 * | 8/2024 | Wimmer | B65B 27/04 |

FOREIGN PATENT DOCUMENTS

| | | | |
|---|---|---|---|
| EP | 2085314 | A2 | 8/2009 |
| WO | 2021043632 | A1 | 3/2021 |

OTHER PUBLICATIONS

Priority Application: DE 10 2022 115 413.0 Filed Jun. 21, 2022—German Search Report dated Aug. 11, 2023.

PCT Application: PCT/EP2023/060963 filed Apr. 26, 2023—International Preliminary Report on Patentability dated Jan. 2, 2025.

* cited by examiner

Fig. 1C
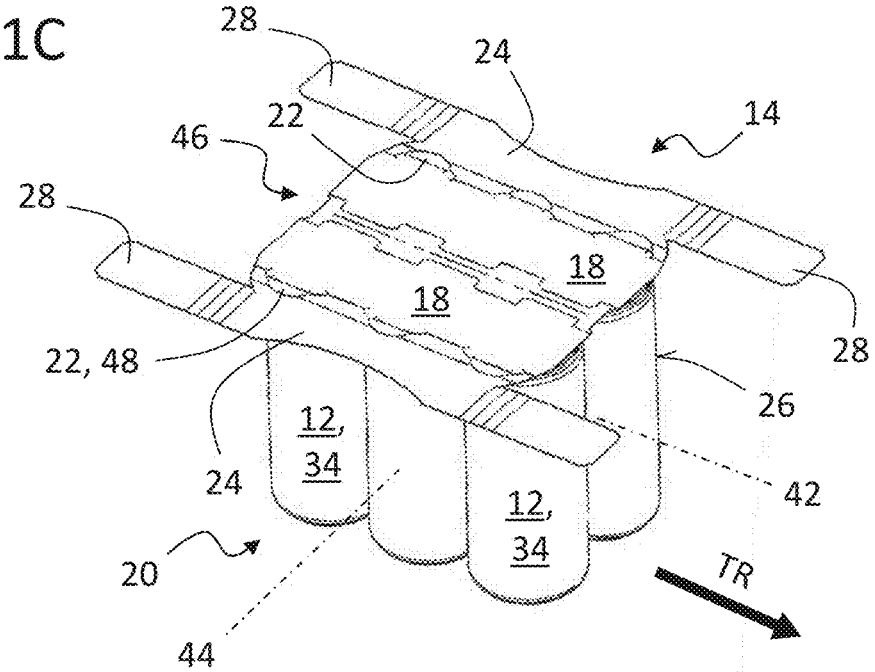
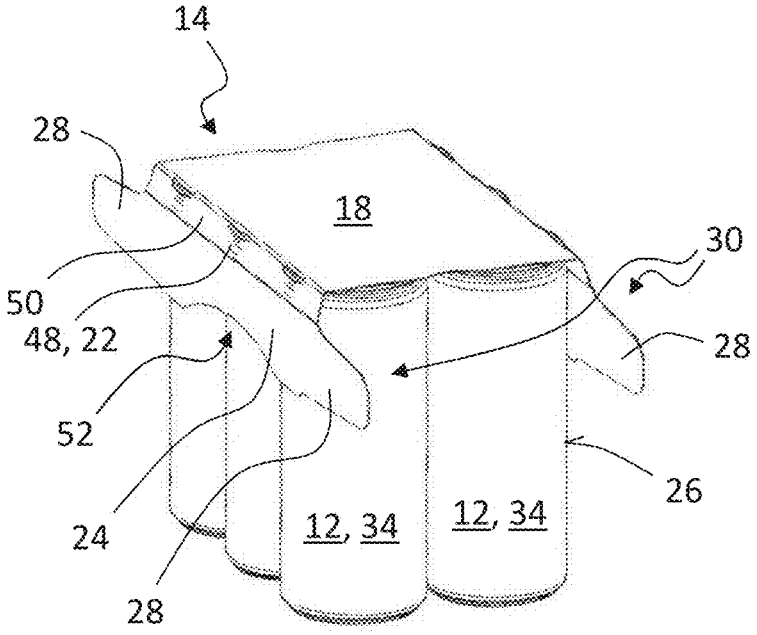
Fig. 1D

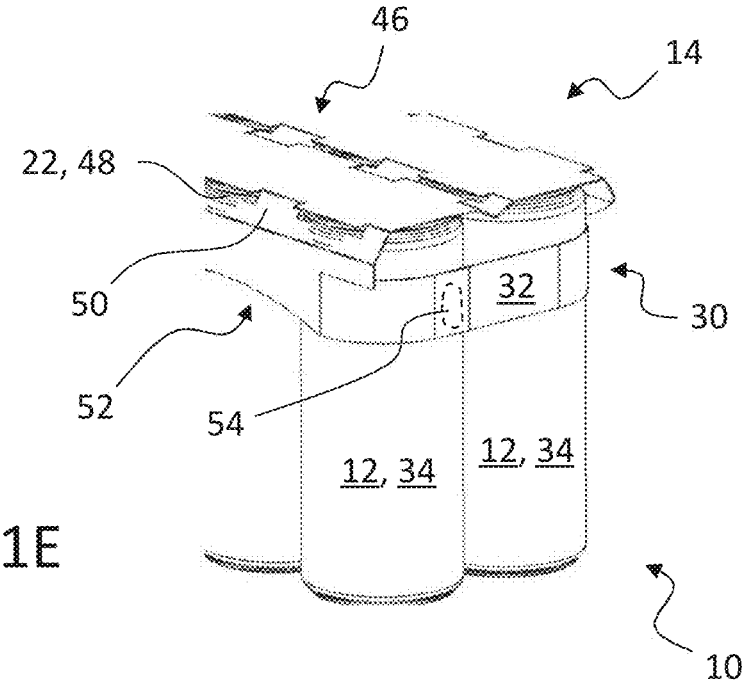
Fig. 1E
Fig. 1F
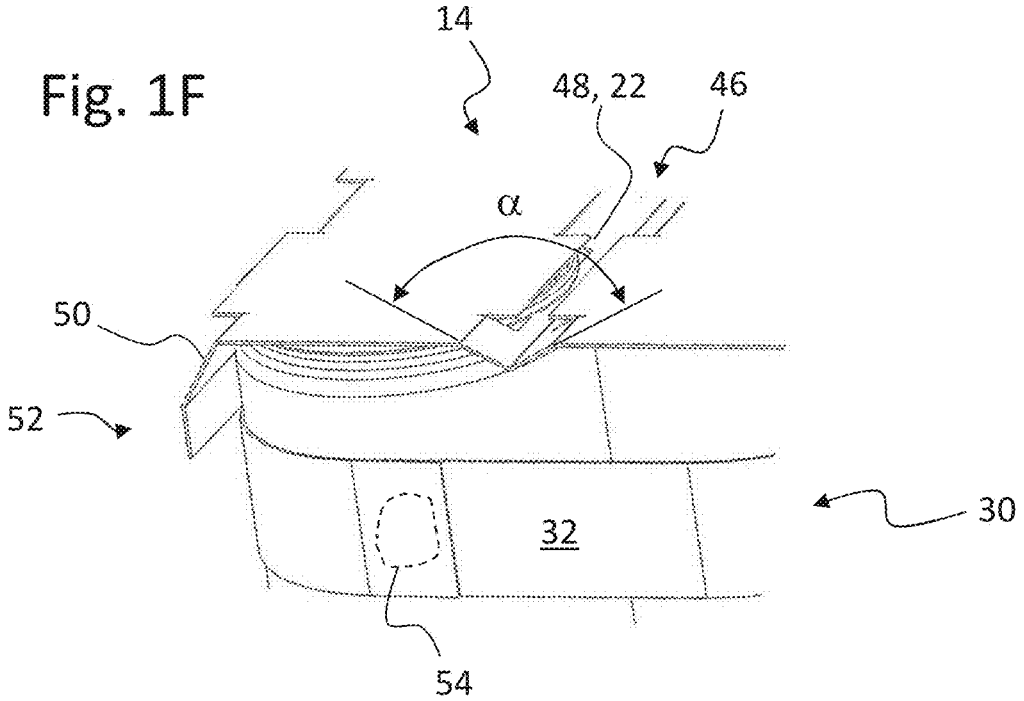

METHOD AND PACKAGING DEVICE FOR PRODUCING PACKAGING UNITS, AND APPLICATION HEAD FOR CORRESPONDING USE

CLAIM OF PRIORITY

The present application claims priority to International Application PCT/EP2023/060963 dated Apr. 26, 2023, which in turn claims priority to German Application DE 10 2022 115 413.0 filed Jun. 21, 2022, which are incorporated by reference.

FIELD OF THE INVENTION

The present invention relates to a method and to a packaging apparatus for producing packaging units. In addition, the invention relates to a controllable application head that can be moved within a defined movement space for attaching packaging blanks to article groupings for the purpose of producing packaging units and/or for applying the method for their production.

BACKGROUND OF THE INVENTION

Along with bottles and beverage cartons, beverage cans are one of the most important commercial packagings for beverages, produced and used in large numbers, especially since they can also be used as drinking vessels. Beverage cans are used primarily for carbonated beverages, such as canned beer and soft drinks, such as cola beverages, sodas of all types, and energy drinks. Beverage cans are typically opened for consumption by tear-off tabs arranged on the lid.

Beverage cans currently in use mostly consist of one-piece, cylindrical containers made of aluminum or tinplate, manufactured using suitable deep-drawing methods, and aluminum lids with an oval scored line and a riveted-on metal tab, which are folded or flanged onto the upper edges of the can. This tab acts as a kind of built-in can opener when it presses the scored oval into the inside of the can by leverage when it is lifted, thus forming a pouring or drinking opening. The cans normally have a tapered diameter in the upper shell region directly below the lid. This means that the lid normally also has an outer diameter that is at least slightly smaller than the cylindrical shell region of the can.

In principle, there are a plurality of different types of packaging for processing, assembling, grouping, and packaging articles such as beverage containers in the form of cans. A suitable type of packaging is, for example, the grouping of articles or containers into portable, relatively handy bundle units, which can generally also be regarded as packaging units. Here as well, various options are known for combining individual cans into larger bundles. For example, beverage containers are often combined and packaged using shrink films to form bundles of four, six, or more containers. The production of such bundles or packaging units is indispensable in many cases, because they are the most common variant of sales units or packaging units for beverage containers, in particular cans made of metal or plastic or bottles made of PET plastic. This is because the handling of a large number of articles or beverage cans on the way from the production and filling of such so-called primary packaging to the retailer and the end customer is hardly conceivable without the use of so-called secondary packaging and possibly also additional tertiary packaging. The bundles, which can also be considered secondary packaging, are sometimes combined again for transport and/or assembled in layers and palletized, which is sometimes also referred to as tertiary packaging.

Specific fabrication steps are required in the production of known bundle types in order to be able to process the shrink films normally used for the bundles. Such fabrication steps require a relatively high energy input, not least because of the shrinking process of the film that takes place under the effect of heat. In addition, the film used incurs costs for production, provision, handling, as well as later disposal, since it is no longer required after sale and the unpacking of the articles or containers. The machine configuration for providing the so-called film wrapping modules and other handling stations also incurs high investment costs. Finally, a relatively high investment of capital is also needed for the provision of the so-called shrink tunnel, with which the film wrapped around the bundle is shrunk around the containers by hot air application.

A variant in which the use of shrink films can basically be dispensed with are so-called strapping bundles. In this case, a plurality of articles or containers are connected to one another by so-called strapping bands and combined into a bundle. In continuous or cyclically operating strapping machines, containers, articles, or bottles are grouped into formations and are then strapped with one or more bands using strapping assemblies. It is practical for such bands to run in the horizontal direction around the containers or bottles and hold them together in the bundle assembly. Typical formations can, for example, be 1×2 arrangements (two containers in a row), 2×2 arrangements (four containers in a square or diamond formation), 3×2, 4×3, or in principle also variable n×m arrangements.

Furthermore, the use of so-called gripping cardboard packages or upper gripping cardboard packages is known in order to combine a plurality of articles such as beverage containers, in particular bottles or cans, via their neck regions. A packaging machine for placing such upper gripping cardboard packages is described in the patent specification EP 1 075 419 Bl. There, the articles are arranged in a crate, and the gripping cardboard packaging is placed on top of the at least one article arranged in the crate. In particular, a plurality of articles are arranged in the crate, and, by placing a smaller number of upper gripping cardboard packages on top, subgroups are formed, each of which combines some of the articles arranged in the crate.

In addition, packaging units are known which combine different types of secondary packaging means and the plurality of articles together with a first packaging means and a second packaging means, in particular with a first secondary packaging means in the form of an upper gripping cardboard package and with a second secondary packaging means in the form of a strapping and/or in the form of at least one adhesive connection between articles that are adjacent and that contact one another.

The published patent application DE 10 2006 028 661 A1 shows a packaging unit with bottles and a bottle carrier, such that the packaging units can also be stacked reliably in large numbers. The bottles are combined in the packaging units by a carrier body with a carrier handle and at least one band.

A further bundle arrangement is disclosed by US 57 75 486 A. Rows of three or six bottles or cans are in each instance fixed with upper-side attachments made of cardboard and combined into larger bundles by strapping bands.

Many different can sizes are now commonly used and available as primary packaging for holding liquid contents, in particular beverages. While cans with a volume capacity of around a third of a liter or half a liter were traditionally offered, cans with other capacities, e.g., 0.15 liters, a quarter of a liter, 0.355 liters, or other volumes, are now also frequently available.

In addition to these varying can volumes, different can shapes are known. While the lid of a standard can has a significantly smaller diameter than the adjoining can cylinder, the cylinder diameter and the lid diameter of so-called slim cans or sleek cans are substantially the same or nearly the same, such that there are no significant tapers in the lid and/or base region relative to the shell region of the can.

For combining standard cans, upper gripping cardboard packages that have a number of openings for the standard cans, which simultaneously define the positions of the cans within the packaging unit, are known. The gripping cardboard packages are pressed onto a set of standard cans from above, such that the lid region of the standard cans can pass through an assigned opening. Preferably, the gripping cardboard package is anchored below the lid region of the standard cans, in particular in the region of reduced cross-section. The cans are arranged close together within the packaging unit produced in this way.

By contrast, the use of such gripping cardboard packages is usually not useful in the case of so-called slim cans or sleek cans. Since the diameter in the lid region and the diameter in the cylinder region are largely the same in such can shapes, there is a lack of material between the openings of the gripping cardboard, such that the remaining narrow regions between the openings can easily tear out, as a result of which the gripping cardboard lacks the necessary stability.

To counteract these disadvantages, WO 2021 043 632 A1 proposes a combination of a gripper cardboard packaging acting as the primary packaging material with another packaging material. This additional packaging, known as secondary packaging, is then attached to the packaging already equipped with the gripper cardboard packaging. Strapping bands, adhesive connections between articles, or shrink film connections are proposed as secondary packaging materials. In order to equip several articles, such as the so-called slim cans mentioned above, with primary and secondary packaging materials, multi-phase manufacturing processes are required, since these are fundamentally different types of packaging and therefore also different mechanical production and packaging steps.

In view of the known types of packaging and packaging methods, it can be considered a primary object of the invention to combine or integrate the necessary process steps for the production of packaging units with a plurality of different packaging means in an improved manner. In addition, it can be considered a further objective of the invention to be able to produce packaging units in an advantageous manner in which in each instance a plurality of articles are combined with first and second packaging means, wherein these packaging means interact more closely than is the case with previously known packaging variants. Finally, a further objective is to provide an improved tool that enables more rapid and better processing of grouped articles for the purpose of producing packaging units.

SUMMARY OF THE INVENTION

These objectives of the invention are achieved with the subject matter of the independent claims. Features of advantageous further developments of the invention are apparent from the respective dependent claims.

In order to achieve at least some of the aforementioned objectives, the invention proposes a controllable application head which is movable within a defined movement space and which is used to attach packaging blanks to groups of at least two articles each. This application head comprises a receiving device for receiving at least one packaging blank and for placing the packaging blank on an upper side of the relevant article grouping.

Furthermore, the application head is equipped with a fixing device for establishing a mechanical connection of the packaging blank to the article grouping. The receiving device of the application head comprises at least one suction device which can be subjected to a controllable and/or variable negative pressure and which can be subjected to an increased negative pressure for receiving and holding a packaging blank and to a reduced negative pressure for releasing a packaging blank held in the application head. Optional further handling tools of the application head are described in detail below.

The application head according to the invention can be equipped with at least one application unit for treating one article grouping each and for equipping them with a packaging blank. In particular, however, the application head comprises two or more such application units for the substantially synchronous treatment of two or more separate article groupings and for equipping them with packaging blanks.

The application head can preferably be moved within a movement space between a supply or provision location for a plurality of stacked packaging blanks and a location in each instance of the article groupings to be treated.

In addition, the application head can be configured in such a way that each of its application units is equipped with a contact plate, movable vertically between two end positions, for the flat contacting of the packaging blank held there, as well as with, in each instance, at least one controllable suction element for the negative-pressure-controlled holding or release of a packaging blank held there with negative pressure.

Furthermore, each application unit of the application head can be equipped with a shaping element for deforming a defined folding region of a packaging blank placed on a corresponding article grouping. In particular, it can be provided that the shaping element be used to form primary fixing device for producing mechanical connections between the articles of the article grouping and the packaging blank, or support the formation of the primary fixing device.

Furthermore, each application unit can optionally be equipped with folding elements for folding over side surfaces of the packaging blank that project beyond an upper side of the article grouping and for preparing secondary fixing device between the article grouping and the packaging blank.

Furthermore, in the application head according to the invention, it can be provided that the movable contact plate, the suction elements that can be subjected to negative pressure, the folding elements, and the shaping element of each application unit, in conjunction with the application head that can be lowered onto the article grouping or lifted off from there, each be able to carry out coordinated handling steps, coordinated with each other, for forming the primary fixing device and at least preparing the secondary fixing device. The subsequent completion of the secondary fixing device, which are formed in particular by strapping sections, can take place in subsequent handling or process steps, unless appropriate tools are provided in the application head which are able to complete the strapping sections—for example, by gluing overlapping strip sections of the packaging blank.

To achieve at least some of the aforementioned objectives, the invention further proposes a method for producing packaging units each comprising at least two articles, wherein the at least two articles are held together by at least one packaging blank. The at least two articles of the packaging units produced by the method according to the invention are in particular articles that are of the same type or are identical.

The method according to the present invention comprises at least the steps listed and explained below. First, there takes place the transfer of a flat packaging blank from a supply, from a feeder, or from another provision location using an application head. After being received or transferred, the packaging blank is held in the application head and, in particular, held ready for subsequent process steps.

Together with the packaging blank held or kept ready, the application head is moved to a previously prepared article grouping, consisting of the mentioned at least two grouped articles, which is held ready for the handling steps described here, where the head can be lowered directly onto the article grouping or initially positioned at a vertical distance above the article grouping. Such a positioning of the application head at a vertical distance above the article grouping held ready can be useful, for example, if the article grouping is not at rest, but is moved along a conveyor line, because in this case a movement of the application head in the same direction and pulling along with the article grouping moved in a conveying direction on the conveyor line is useful, which is also commonly referred to as synchronization or synchronizing.

If it is ensured that the packaging blank is in a desired position in relation to the article grouping by exact positioning of the application head, the application head can be lowered onto the article grouping, which equally entails and enables the packaging blank to be applied to an upper end face of the article grouping. Such application of the packaging blank to the upper end face of the article grouping, which generally refers to the upper lid sides of the grouped articles, implies the establishment of a mechanical connection between the packaging blank and the article grouping.

This mechanical connection between the upper end face of the article grouping or the upper cover sides or cover regions of the grouped articles is also referred to in the present context and hereafter as the primary connection, the primary fixing, or the manufacture, attachment, or formation of primary fixing device. As a rule, this refers to latching connections between punched-out circular apertures in the packaging blank and upper rim sections of the articles formed in particular by metal beverage cans, which will be explained in more detail below.

To prepare additional secondary fixing device, which, in the packaging units to be produced here, are formed by strapping sections formed from parts of the packaging blank, after the mechanical connection between the packaging blank and the article grouping has been established, at least one foldable section, projecting beyond an upper side of the article grouping, of the packaging blank is folded over and applied against a side surface of the article grouping.

Normally, two foldable sections located opposite one another on the longitudinal sides of the main surface, covering the upper side of the article grouping, of the packaging blank are folded or bent over and placed against the opposite side surfaces of the article grouping, which corresponds to a folding process with a folding angle of approximately 90 degrees. From these folded, foldable sections of the packaging blank, the strapping sections described in more detail below are formed, which in the present connection are also considered secondary fixing device of the packaging units and are referred to as such. Such primary fixing device initially fix the positions of the articles relative to one another.

Subsequently, at least one side surface adjacent to a longitudinal side of the main surface of the packaging blank is folded over, forming secondary fixing device interacting with the shell surfaces of the articles. The secondary fixing device are formed by strapping sections that surround defined regions of the shell surfaces of the articles and fix the articles in a substantially parallel alignment to one another. The strapping sections of the secondary fixing device are formed in particular by strip sections of the packaging blank, which extend the side surfaces in directions along the longitudinal extension directions of the side surfaces.

Only after the aforementioned lateral foldable sections of the packaging blank have been folded over or folded down is the application head lifted off the article grouping equipped with the packaging blank and held together mechanically by it, and then able to be removed from the article grouping in order to pick up another packaging blank from a provision location or a supply and to repeat the described process steps on another article grouping.

The application head is thus movable within its movement space between a supply or a provision location for the flat and normally still unfolded packaging blanks, but provided with the necessary cutouts and openings, and a provision location or a conveyor section with the article grouping located there. Here, it is provided that the application head as a whole, together with the packaging blank held therein, be lowered onto the article grouping.

The picking up of at least one packaging blank from the storage stack or from a suitable and equipped provision location can be carried out in particular with the aid of negative pressure, i.e., for example, by suitable suction elements which are located in the application head and which can be subjected to negative pressure in order to pick up a flat packaging blank. Preferably, such negative pressure can be deactivated for dispensing the packaging blanks. Therefore, if a packaging blank is to be placed on an article grouping after synchronization and the lowering of the application head and pressed on and latched there while forming the primary fixing device, it is practical to deactivate the negative pressure applied to the suction elements, which can release the packaging blank and release its previously temporarily maintained fixation in the application head.

The release of the packaging blank and its locking on the top of the intended article can be supported by additional components in the application head. For example, the formation of the primary fixing device can be supported by lowering a flat contact plate of the application head, while at the same time the negative pressure of the suction elements or suction punches holding the packaging blank in place is deactivated. These processes can usefully be combined with one another, in particular by lowering the application plate relative to the suction elements or suction punches which are fixed in the application head and extend through the application plate, which is equipped with corresponding openings.

In this way, the packaging blank temporarily held in the application head can be spaced apart from the suction elements or suction punches and detached. The mentioned contact plate can be configured to be movable relative to the application head, in particular by linear guides. In this way, the plate can be lowered relative to the application head when it is held in position and can thus press the packaging blank downwards onto the article grouping immediately, in terms of time and/or the process, before the primary fixing device are produced.

As the production of the packaging units continues and the contact plate continues to move downwards, the packaging blank is connected or locked to the articles of the article grouping, forming the primary fixing device, e.g., by forming locking connections between the openings or perforations in the packaging blank and the neck portions of the articles.

In addition, the method according to the invention for producing the packaging units can provide that the main surface, placed on the top of the article grouping and in particular locked or otherwise fixed there, of the packaging blank be reshaped, folded, or notched in a region between adjacent articles or between adjacent rows of articles, wherein adjacent primary fixing device together with the articles held therein are brought closer to one another, in particular until the adjacent articles touch each other.

Thus, the method can provide that, during the production of the primary fixing device, but in particular not until thereafter, the packaging blank be handled and deformed in such a way that it is pressed at least some distance between adjacent articles of the article grouping or between adjacent rows of articles of the article grouping, which can be particularly expedient for those articles within the article grouping which, due to their shape, provide only a small amount of material between adjacent articles because the diameter of the upper edge of the article is not reduced, or is reduced only insignificantly, compared to the diameter of the adjoining cylindrical shell region.

If the article grouping provided for the packaging units to be produced is formed, for example, by the slim cans or sleek cans mentioned above, the special shaping of such beverage cans, which are cylindrically shaped almost continuously and with a constant diameter from the lower base region to the upper lid region, means that virtually no residual material of the flat packaging blank is available between the immediately adjacent articles or cans of the grouping when the primary fixing device are produced. In order to compensate for this, the method provides for a sufficient distance between adjacent articles or adjacent rows of articles, at least for the production of the primary fixing device, which are formed by placing and locking the articles or beverage cans in openings provided for this purpose in the flat packaging blank, which distance is eliminated in subsequent process phases by pushing the articles or rows of articles together.

When, in this context, reference is made to adjacent rows of articles which are initially spaced at a distance from one another, this may in particular mean two, three, or four articles or cans which are lined up next to one another and which stand next to one another in pairs, thus forming a grouping of a total of four, six, or eight articles. However, the articles in such rows, which are initially spaced apart in pairs, are preferably in touching contact with one another, which can be accepted with regard to the available flat material of the packaging blank, since the mechanical holding together of the packaging units to be produced in this way can be ensured not only by the primary fixing device, but also by the secondary fixing device to be explained in detail below.

After lowering the contact plate together with the packaging blank resting against it on the lower side onto the upper side of the article grouping and after latching the articles to the packaging blank, which was defined above as producing the primary fixing device, the articles or rows of articles of the respective grouping, which are at least slightly spaced apart from one another in such process phase, can be subjected to a further handling step, which, among other things, provides for the articles or rows of articles of the grouping to be brought together until they are in touching contact, such that the usual rectangular arrangement of the grouping is produced, which also corresponds to the arrangement within the packaging units to be completed later.

Thus, in a further method step, the method according to the invention can provide that a region, located between the spaced-apart articles or rows of articles, of the main surface, lying on the upper sides of the articles, of the packaging blank be notched in a V-shape and pressed into the space between the articles or rows of articles, which can optionally be supported by folding or crease edges previously made in the packaging blank. In the case of a rectangular packaging blank, a central strip, which is to be notched in a V-shape in this way, divides the main surface into two equal halves, which are connected by such central strip.

Each of such two halves of the main surface of the packaging blank covers one article if the article grouping to be processed comprises only two articles. In the case of article groupings with, for example, four or six articles, each of the two halves of the main surface of the packaging blank thus covers a row of two or three articles.

The V-shaped section, formed in this way, of the packaging blank and the pressing in of the shaped region between the articles or rows of articles can be carried out in particular by a knife-like or blade-shaped shaping element arranged in a stationary position in the application head, which shaping element, when the contact plate is lowered, lies above the level of the contact plate and is thus covered by it, so that it cannot become effective when the packaging blank is pressed onto the top of the article grouping and during the simultaneous forming of the first fixing device.

By lifting the contact plate after the primary fixing device have been produced and with the suction elements or suction punches preferably deactivated, the knife-like or blade-shaped shaping element extends through a corresponding recess in the contact plate and thus projects downwards out of the contact plate, as a result of which it can press the packaging blank down in a V-shape between the articles or rows of articles when the contact plate is raised and the application head is lowered further at the same time, wherein the V-shaped region of the packaging blank is pressed in between the adjacent articles or adjacent rows of articles.

Since the articles or rows of articles that were previously spaced apart are thereby pulled together, suitable guides are expedient in order to allow this bringing together to take place in a controlled manner. In principle, creating the V-shaped area and lowering it between the articles or rows of articles is enough to bring them closer together and to ensure that they are pulled or pushed towards each other.

The lowering movement of the application head with the pressing of the knife-like or blade-shaped shaping element onto the main surface, on the upper side, of the packaging blank can also be used to fold the side surfaces of the packaging blank that are located at the rim of the main surface of the packaging blank downwards by approximately 90 degrees in each instance and place them against the side surfaces of the article grouping. Such folding movements can be carried out, for example, by lateral folding elements arranged in a fixed position in the application head if the application head is lowered further towards the upper side of the article grouping.

The folding elements arranged on the application head on both sides of the contact plate and at a distance from it can be formed either by rigid or by movable tools, which are preferably located in a position in the application head where they can meet the areas of the flat packaging blank defined by folding or folding edges and thus delimited from the main surface in order to apply them to the oppositely situated side surfaces of the article grouping. In a simplest variant embodiment, the folding elements are formed by vertically downward-projecting and, for example, strip-shaped sections which are anchored to a carrier plate or a carrier element of the application head, so that their unchangeable relative positions are fixed in relation to the suction elements and in relation to the contact plate which can be raised and lowered in the application head.

A ramp-like bevel on the folding elements can, for example, support the previously spaced articles or rows of articles being pushed together when the knife-like or blade-shaped shaping element is activated.

In a later method step, possibly after further handling and/or treatment steps with which further measures can be taken to complete the packaging units, the entire application head is lifted upwards from the article grouping in order to leave it to the next processing, handling, and/or application steps. Such steps can include, in particular, the further processing of the secondary fixing device by folding the strapping sections, bonding overlapping and superimposed sections, etc.

Thus, an advantageous method variant provides that the previously folded side surfaces and the extended strip sections formed thereby be folded over by suitable handling devices and formed into strapping sections, wherein overlapping end regions of these strip sections are fixed to one another and/or to the shell surfaces of the articles.

However, it should be emphasized at this point that fixing and/or bonding the strip sections to the shell surfaces of the articles is merely an option that can be implemented as desired in practice. Due to the fixing of the packaging blank to the articles with the formation of the primary fixing device, the holding together of the bundle structure may already be sufficient, such that an adhesive fixing of the strip sections to the underlying shell surfaces of the articles is not necessary.

However, if the articles are not only to be surrounded by the strapping sections in sections, but also fixed there in their relative positions to one another, it can be practical to additionally fix the strip sections to the shell surfaces of the articles in conjunction with the fixing of their superimposed and thus overlapping sections to one another.

With regard to all previously described method variants for producing or preparing packaging units by shaping and equipping grouped articles with packaging blanks, preferably using an application head that carries out at least some of the aforementioned method steps, it can be provided in a minimal configuration that the application head act upon exactly one article grouping in the manner described and equip it with the packaging blank and shape and/or prepare it for producing the primary fixing device and at least for preparing the secondary fixing device.

Preferably, however, the application head has two, three, or more similarly equipped handling regions for the simultaneous and largely synchronously executable treatment of two or more article groupings provided for this purpose. Thus, at least two, optionally also three, such modular application units can be arranged side by side within an application head, so that two or three similar article groupings can be processed or handled in parallel in the manner described.

Optionally, four such modular application units can be located in a grouped rectangular arrangement within an application head, so that four similar article groupings can be processed and/or handled in parallel in the manner described in a parallel processing, wherein these article groupings are to be positioned and aligned in such a way that the application head lowered onto them with the four application units or application modules positioned in a rectangular arrangement can apply the four simultaneously grasped packaging blanks to the article groupings ready for this purpose, and can also carry out all of the other process steps described.

Thus, when in the present context reference is made to an application head for handling and processing at least one article grouping or a plurality of article groupings, this means either an application head in the minimum configuration mentioned, which is capable of handling or processing only a single article grouping. However, the application head can also allow a parallel and synchronous handling and processing of a plurality of article groupings and can be equipped with a corresponding number of application units or application modules. In this case, the corresponding suction elements, movable contact plates, and other tool elements of the application head can also expediently be controlled synchronously, wherein the contact plates, which can be raised and lowered in parallel movements, are typically equipped with separate motor drive units, while a central negative pressure supply for the joint feeding of the controllable suction elements is an option that makes sense, because the suction elements can easily be coupled to a common feed line via hose lines.

If, from the point of view of a person skilled in the art, a useful combination with one another is possible, some of the or all of these aforementioned variations or embodiment variants of the method according to the invention and/or of the application head according to the invention can optionally also be combined with one another in order to at least partially achieve the above-formulated objective(s), and/or to achieve the desired effect of the invention.

It should be expressly mentioned at this point that all aspects and embodiment variants which have been explained in connection with the application head according to the invention can also relate to, or form, partial aspects of the method according to the invention. Therefore, if the description or the claim definitions pertaining to the application head according to the invention make mention of certain aspects and/or correlations and/or effects, this applies equally to the method according to the invention.

The same applies vice versa, so that all aspects and variant embodiments which have been explained in conjunction with the method according to the invention can also relate to, or be, partial aspects of the possible use according to the invention and/or for equipping the application head according to the invention. Therefore, if the description or the claim definitions pertaining to the method according to the invention make mention of certain aspects and/or correlations and/or effects, this applies equally to the application head according to the invention. This head can be equipped in such a way that all variants of the method explained above can be carried out.

Furthermore, the present invention comprises a packaging apparatus for producing packaging units which are each formed by at least two articles, wherein these at least two articles of the packaging units are held together by at least one packaging blank. The packaging apparatus according to the invention comprises at least one conveyor device, a transport section, and/or a provision position for conveying grouped articles and/or for providing the grouped articles, as well as an application device for equipping the article groupings with at least one packaging blank each, wherein the application device comprises at least one controllable application head that is movable within a defined movement space.

In the packaging apparatus according to the invention, it is provided that the application head be able in each instance to equip at least one article grouping, located within the movement space and/or moving there, with a packaging blank and be able to apply this blank to the article grouping. In addition, the application head of the application device is equipped with controllable devices for picking up, holding, and releasing the packaging blanks. In addition, the application head is equipped with controllable tools for producing a mechanical connection between each article grouping and the packaging blank applied to it.

The packaging apparatus according to the invention can in particular be equipped with an application head as described above in various variant embodiments.

Furthermore, the packaging apparatus according to the invention can be prepared and equipped in such a way that it is suitable for carrying out a method according to one of the method variants described above, in particular using at least one application head according to the above description.

BRIEF DESCRIPTION OF THE FIGURES

Exemplary embodiments of the invention and their advantages are explained in more detail below with reference to the accompanying figures. The proportions of the individual elements relative to one another in the figures do not always correspond to the actual proportions, since some forms are simplified, while other forms are shown enlarged in relation to other elements for better illustration.

FIGS. 1A to 1F show schematic views of various interacting individual components that can be reworked and formed into packaging units.

DETAILED DESCRIPTION OF THE INVENTION

Figure 1A:
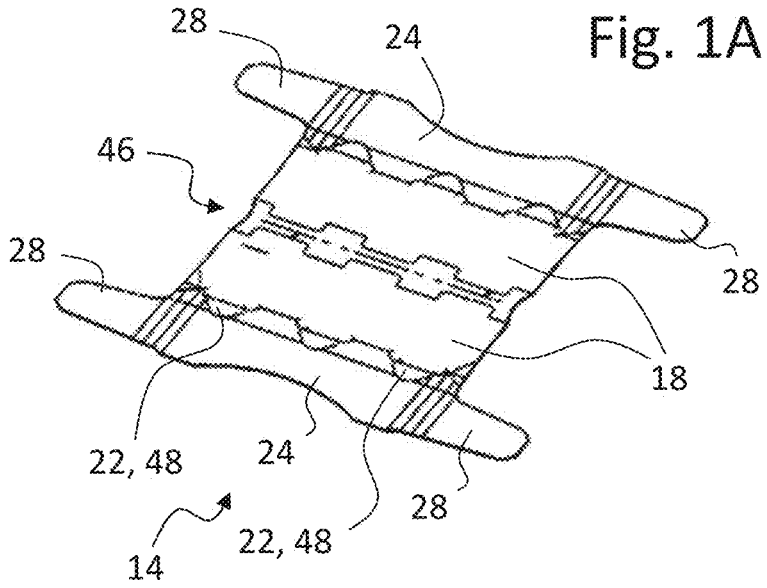

As a rule, the same reference signs in each instance are used in FIGS. 1A to 5 for elements of the invention that are identical or have the same effect. Furthermore, for the sake of clarity, reference numerals are only shown in the individual figures if they are necessary or practical for the description of the respective figure. The embodiments shown are merely examples of how the application head according to the invention, the packaging apparatus according to the invention, or the method according to the invention can be configured for producing packaging units, and are non-limiting.

Figure 1B:
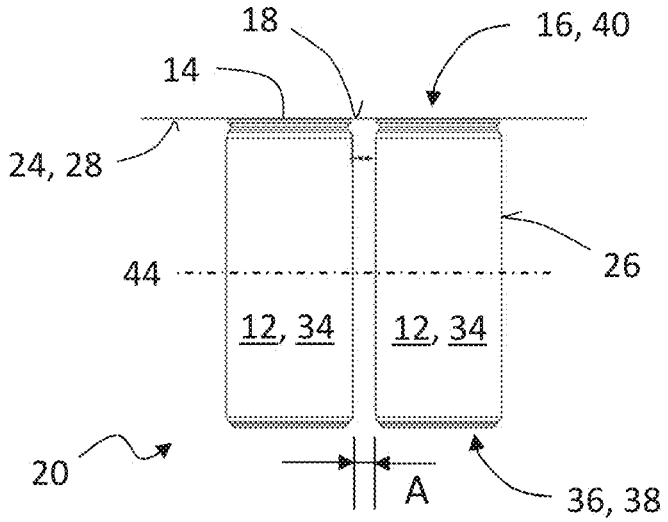

Based upon the perspectival and schematic views of FIGS. 1A and 1C to 1F as well as the schematic side view of FIG. 1B, some important fundamental principles in the production of packaging units 10 by joining together a plurality of articles 12 and by mechanical combination by a packaging blank 14 will first be clarified.

It should be expressly emphasized that FIGS. 1A to 1F show the individual components of such a packaging unit 10 to be assembled and treated in the manner described below, as they can be produced in particular with the aid of the method according to the invention and with the preferred use of an application head 60 according to the invention and/or with the use as intended of a packaging machine according to the invention. In this respect, FIGS. 1A to 1F initially illustrate only a single packaging unit and its components, without going into more detail about the configuration of the application head 60 (cf. in this regard FIGS. 2A to 2D) or the packaging machine (cf. in this regard FIG. 5).

In the following context and the context of the entire description, mainly packaging units 10 are spoken of, but the equally common term "bundle" can also be used instead. The term "packaging unit 10" used here is intended to refer to the finished unit, which can be handled as a complete unit, possibly also stackable unit and/or unit that can be purchased and used by the end customer in retail stores, formed of at least two articles 12 and the packaging means mechanically combining them.

In the exemplary embodiment shown, the packaging units 10 assembled and fabricated by the production process described below comprise a total of six similar articles 12, which are held together in a rectangular arrangement by a flat packaging blank 14.

In the method for producing the packaging units 10, the packaging blank 14 (cf. FIG. 1A), prepared for this purpose and brought into the depicted shape by, for example, a stamping method, is first placed on and/or applied to the article grouping 20 with a main surface 18 covering the first or upper end faces 16 or cover faces of the article 12 grouped in the 3×2 rectangular arrangement (cf. FIGS. 1B and 1C). The term "main surface 18" used here refers to the rectangular portion of the flat packaging blank 14, which portion covers the articles 12 arranged as article grouping 20 in the 3×2 rectangular arrangement on their upper end faces 16.

In connection with the placement and through the application of the packaging blank 14 onto the upper side of the article grouping 20, i.e., onto the upper end faces 16 of the grouped articles 12, connections between the articles 12 and primary fixing device 22, so designated here, of the packaging blank 14 are formed. The primary fixing device 22 hold the packaging blank 14 on the articles 12; in addition, the primary fixing device 22, explained in greater detail below, define the positions of the articles 12 relative to one another, because the dimensioning of the main surface 18 of the packaging blank 14 and the positions of the primary fixing device 22 are coordinated with the dimensions and diameters of the articles 12 and of the article grouping 20 consisting of a plurality of articles 12.

After the packaging blank 14 has been placed with its main surface 18 on the upper side of the article grouping 20 (FIG. 1C) and in conjunction with the formation of the primary fixing device 22, the side surfaces 24 of the packaging blank 14, which are located on both longitudinal sides of the article grouping 20, are folded over according to FIG. 1D and placed against shell surfaces 26 of the articles 12, but without following the curved contours of the shell surfaces 26.

The side surfaces 24 arranged in strips on the two longitudinal sides of the main surface 18 form a continuation of the main surface 18 of the packaging blank 14. Together with strip sections 28 that continue to both narrow sides of the side surfaces 24, the two side surfaces 24 adjacent to the main surface 18 of the packaging blank 14 form secondary fixing device 30, which, when applied to the shell surfaces 26 of the articles 12, interact with them.

As FIGS. 1A and 1C clearly show, the side surfaces 24 are in each instance significantly longer than the main surface 18 due to the strip sections 28 extending them on both sides. The total length of the side surfaces 24 together with such strip sections 28 extending them to both narrow sides can be approximately twice the length of the longitudinal side of the main surface 18 or slightly less.

By fixing overlapping end regions of the strip sections 28 to one another and/or by fixing them to the shell surfaces 26 of the articles 12, the secondary fixing device 30 are formed by strapping sections 32, as can be seen in the schematic perspectival view of FIGS. 1E and 1*n* the perspectival detail view of FIG. 1F There, the strapping sections 32 each surround defined regions of the shell surfaces 26 of the articles 12, and specifically on both opposite narrow sides of the article grouping 20.

The articles 12, which are fixed and held in position by the strapping sections 32, can be swiveled or displaced only minimally when the packaging unit 10 (FIG. 1E) is completed in this way, such that the secondary fixing device 30 thus fix the articles 12 within the packaging unit 10 in a substantially parallel alignment of their longitudinal central axes to one another.

As can be further seen in FIGS. 1A, 1C, and 1D, the strapping sections 32 of the secondary fixing device 30 (cf. FIGS. 1E and 1F) are formed by the strip sections 28 of the packaging blank 14, which extend the side surfaces 24 at both narrow sides in directions along the longitudinal extension directions of the side surfaces 24.

The folding over of the side surfaces 24 and the placement of the strip sections 28 by suitable handling devices and the reshaping to form the strapping sections 32, in which overlapping end regions are fixed to one another and/or to the shell surfaces 26 of the articles 12, is explained and illustrated below by way of example with reference to FIG. 2A ff.

As is already clear from the consideration of FIG. 1A to 1E, the articles 12 can in particular be beverage cans 34, which is why the articles 12 marked here are also denoted throughout with the reference number 34 in the present context. The beverage cans 34 used here are in particular so-called slim cans or sleek cans made of a suitable metal sheet, in particular of a suitable aluminum alloy. Optionally, the cans or beverage cans 34 can also be made of plastic or of a composite material, in particular of a multi-layer composite material.

The beverage cans 34 illustrated in their typical contours in the schematic side view of FIG. 1B are shaped hollow-cylindrically and closed on all sides. They also each have a flat or slightly concave curved circular base region 36 on their lower end faces 38 and a mostly flat circular upper lid region 40 on the opposite end face. This upper lid region 40 forms the aforementioned upper end face 16 of the articles 12 formed by the beverage cans 34.

The flat or slightly concave curved base region 36 on the lower end face can typically be connected in one piece to the cylindrical shell surface 26, which can usually be realized by a deep-drawing process in the case of tin cans.

What in the present context is also referred to as the upper end face 16 of the article 12 is, in the example of the beverage cans 34, their respective upper lid region 40. The lid itself can, for example, be connected to the upper rim of the cylindrical shell of the beverage cans 34 by crimping, such that a can 34 closed on all sides is formed. A smaller tear-off lid or tear-off closure with a tear-off tab or the like may be incorporated within the lid surface, wherein scoring lines can be present as predetermined breaking points in the metal or aluminum sheet, which enable the tear-off closure to be opened to remove the liquid in the beverage can 34. However, such optional tear-off lid and the tear-off tab that may be fastened to it are not shown here, since such parts are not closely related to the formation of the packaging units 10.

As FIG. 1B also clearly shows, the cylinder diameter in the region of the cylindrical shell surface 26 and the outer circular diameters of the base region 36 and of the lid region 40 of the beverage cans 34 shown are substantially the same or nearly the same, wherein the base region 36 and/or the lid region 40 can be slightly retracted or tapered relative to the cylindrical shell surface 26.

Such a can shape with an almost uniformly cylindrical outer contour of largely constant cylinder diameter from the base 36 to the lid 40 is a characteristic feature of such so-called slim cans or sleek cans, whereas conventional (standard) cans normally have significantly smaller diameters in the base and lid regions than in their cylindrical shell regions.

Therefore, when cans 34 or beverage cans 34 are referred to in the present context, this can in principle and in all cases mentioned mean such slim cans or sleek cans.

So-called upper gripping cardboard packages, which are known for combining standard cans and which have a number of openings for the standard cans to pass through, thus simultaneously define the positions of the cans within packaging units formed in this way. The gripping cardboard packages are normally pressed onto a set of standard cans from above, such that the lid region of the standard cans passes through an assigned opening.

Often, the gripping cardboard package is anchored below the lid region of the standard cans, in particular in a region with a reduced cross-section or in a constricted region just below the flanged edge, with which the lid is placed onto the upper edge region of the cylindrical shell region. Within a packaging unit produced thereby, the cans are arranged closely adjacently, normally with touching contact of their shell surfaces.

However, the use of such gripping cardboard packages in so-called slim cans or sleek cans, as can be realized here on the basis of the beverage cans 34, is hardly sensible. Since, with such cans 34, there is little or no difference between the diameter in the lid region 40 and the diameter in the cylindrical shell region 26, there is a lack of material between the openings of the gripping cardboard, such that the regions between the openings of adjacent cans 34 in each instance can easily tear out, as a result of which the gripping cardboard lacks the necessary stability.

For this reason, the articles 12 or beverage cans 34 of the article grouping 20 are spaced apart at least temporarily and for the purpose of attaching the packaging blank 14 and forming the primary fixing device 22 in one of the main horizontal axes of the article grouping 20. FIG. 1B illustrates this defined horizontal distance A of the respectively adjacent articles 12 or beverage cans 34 (here: slim or sleek can) in a direction parallel to the second main axis 44 of the article grouping 20 (cf. FIG. 1C). The two adjacent rows of three articles 12, which together form the article grouping 20, are thus spaced from each other by this horizontal distance A.

The two horizontally aligned main axes 42 and 44 of the article grouping 20 are shown in FIG. 1C and are each illustrated by dash-dotted lines. Thus, in the embodiment variant of the 3×2 rectangular arrangement of the grouped articles 12 or beverage cans 34 shown there, a first main axis 42 runs parallel to the two rows, in each instance with three articles 12 or beverage cans 34 aligned one behind the other or standing one behind the other, while the second main axis 44, which is aligned orthogonally thereto, runs transversely to such rows of three.

Both main axes 42 and 44 are normally oriented horizontally, since the article grouping 20 is usually conveyed in a defined direction of transport TR with the corresponding base regions 36 of the beverage cans 34 standing on suitable transport devices such as, for example, on horizontal conveyor devices suitable for this purpose, and are there also equipped with the packaging blank 14. Therefore, the first main axis 42 runs parallel or in the direction of the transport direction TR (in FIG. 1C, diagonally from top left to bottom right), such that the second main axis 44 is oriented transversely to the transport direction TR.

Thus, the horizontal distance A is also plotted parallel to the second main axis 44, as illustrated in FIG. 1B. In order to be able to ensure, using the primary fixing device 22, the desired reliable fixing of the articles 12 or beverage cans 34 within the packaging blank 14 prepared for this purpose and in particular pre-punched, although, in the case of the slim or sleek cans shown here, which form the beverage cans 34, there is insufficient space for this between the upper lid regions 40 of the adjacent beverage cans 34, it is necessary in the initial phase of equipping the article grouping 20, between the two rows of three of beverage cans 34 parallel to the first main axis 42, to produce the defined distance A.

In the schematic side view of FIG. 1B, such horizontal distance A is shown by way of example between two adjacent beverage cans 34, which represent each of the pairings of articles 12 or beverage cans 34 transverse to the first major axis 42 recognizable in FIGS. 1C and 1D.

This arrangement with rows of beverage cans 34 spaced apart by the horizontal distance A makes it possible to press a folding region 46 of the packaging blank 14 between the upper lid regions 40 of the pairs of beverage cans 34 initially spaced apart by the distance A, as a result of which these beverage cans 34 or these rows of three beverage cans 34 conveyed one after the other in the transport direction TR are simultaneously brought closer together in pairs until in each instance their shell surfaces 26 are in line contact.

The folding region 46 is located in the main surface 18 of the packaging blank 14 and divides it into two rectangular halves (cf. FIGS. 1A and 1B), which are located on either side of a vertical separating plane (not shown separately here), which is located between the pairs of beverage cans 34 spaced apart by the horizontal distance A. The first main axis 42 lies within such vertical separating plane, while the second main axis 44 cuts perpendicularly through the vertical separating plane.

The folding region 46, which subdivides the main surface 18 centrally in the direction parallel to the first main axis 42, forms the primary fixing device 22 by which the articles 12 or beverage cans 34 are held in the composite of the packaging unit 10 as soon as the packaging blank 14 is reshaped in the manner described here, pressed in in the folding region 46, and folded in sections, and the secondary fixing device 30 are brought into position and connected to one another in the intended manner.

After placing the packaging blank 14 (cf. FIG. 1A) with its main surface 18 onto the upper end faces 16 of the articles 12 or beverage cans 34 (cf. FIG. 1C) brought into the article grouping 20 in rectangular arrangement, which are, however, spaced apart from one another in pairs again according to FIG. 1B by the distance A, the side surfaces 24 of the packaging blank 24 that project laterally beyond the opposite longitudinal sides of the article grouping 20 are folded down laterally so that they rest against the corresponding shell surfaces 26 of the beverage cans 34 (cf. FIG. 1D). The side surfaces 24 of the packaging blank 14 are folded by approximately 90°.

In the present context, the extensions, which project in the direction of the two narrow sides of the main surface 18 of the packaging blank 14 clearly over the length of the main surface 18, of the two side surfaces 24 are also referred to as strip sections 28 or as extended strip sections 28, since they have to fulfill a specific function in conjunction with the production and the formation of the secondary fixing elements 30, as can be seen with reference to FIGS. 1E and 1F.

The strip sections 28 are normally not separated from the side surfaces 24 and subsequently attached there, but, rather, are an integral part of the side surfaces 24, wherein the strip sections 28, as well as all other components and functional elements of the packaging blank 14, can expediently be produced in a single, possibly also in a multi-stage, punching process from a cardboard sheet or similar flat packaging material, which has manufacturing and production advantages and provides an easy-to-process aid with which loose articles 12 can be connected and combined to form a packaging unit 10 in the manner described here.

After the side surfaces 24 have been folded over according to FIG. 1D, wherein pre-folded and/or perforated or otherwise predetermined bent edges can be practically used on the longitudinal edges of the main surface 18 of the packaging blank 14, the packaging blank can be further processed in two phases or in multiple phases in order to achieve the final state of the packaging unit 10 according to FIG. 1E (and according to the detail view in FIG. 1F).

This two-phase or multi-phase further processing comprises, after the packaging blank 14 has been placed onto the upper side of the article grouping 20, the pressing in of the main surface 18 of the packaging blank 14 over the entire length of the folding region 46 running centrally through the main surface 18, which, on the one hand, causes the two spaced-apart rows of three with articles 12 or beverage cans 34 to be moved closer together and the distance A to be reduced to approximately a value of zero, which on the other hand also effects the immersion and/or the latching of segments of the upper edges of the beverage cans 34 at their upper lid regions 40 into prepared slot-like recesses 48 within the main surface 18 (cf. FIG. 1F).

In principle, the primary fixing device 22 can also be manufactured and configured in a different way, e.g., by openings in the main surface 18 of the packaging blank, which correspond to the diameters of the beverage cans 34 in their upper lid area 40, so that the beverage cans 34 can be pressed in and locked there when they are put in place.

For this purpose, the folding region 46 can, for example, in the shown form be pressed in a V-shape within the separating plane between the container rows and with a bent edge parallel to the first main axis 42 downwards between the beverage cans 34, wherein, at the transition edges to the main surface 18, which are each connected to each individual one of the slot-like recesses 48 on both sides, it is possible to ensure prepared bent edges, perforations, or the like for a defined chamfer.

The flanks, pointing on both sides to the halves of the main surface 18 divided centrally by the folding region 46, of the folding region 46 deformed in a V-shape and pushed downwards between the container rows, can enclose between them an opening angle α which can lie in expedient orders of magnitude between about 80 and up to nearly 180 angular degrees. In the exemplary embodiment shown in FIGS. 1E and 1F, this opening angle α is at a value of approximately 120°.

However, this value is not to be understood as limiting, since the opening angle of the folding region 46 deformed in a V-shape can be oriented, depending upon suitability, towards the deformability of the used flat material of the packaging blank 14, towards the upper edge contour of the articles 12 or beverage cans 34, towards the can shape, or towards other boundary conditions. However, other contours of the deformed folding region 46 are also conceivable, which deformed folding region does not necessarily have to be reshaped into a V-shape, but can, for example, also have a chamfer-like base with a defined curvature radius or a rectangular cross-sectional contour.

It is also conceivable that the folding region 46 could be bent over sharply by nearly 180 degrees, resulting in material sections being placed against one another, which in this case can be pressed in slightly deeper between the bordering rows of three articles 12 or beverage cans 34. Such a penetration of the material sections of the folding region 45 placed against one another by up to a few centimeters can be a practical option in the fabrication of the packaging units 10.

At opposite sides, the recesses 48 can each detect circle segments of the edges at the upper end faces 16 of the beverage cans 34 with segment angles of approximately 40° . . . 60° (optionally also slightly more or less). As can be seen in FIGS. 1E and 1F, the respective transitions from the main surface 18 to the side surfaces 24 can also optionally be bent twice by 45° in each instance, which as a whole results in the aforementioned bend angle of 90°. In this way, roof-shaped transitions 50 are created in each instance, in which the recesses 48 are located, with which the beverage cans 34 can be latched in each instance.

Once the primary fixing device 22 are activated in this way and the corresponding distances A between the beverage cans 34 are removed, so that the corresponding contact lines between the previously spaced beverage cans 34 in the two longitudinal rows are exactly at the mentioned separating plane, the secondary fixing device 30 can be activated. The primary fixing device 22 are already realized here by the beverage cans 34 held relatively firmly in the packaging blank 14, as a result of which the relative positions of the beverage cans 34 with respect to one another are largely fixed. Since the beverage cans 34 are fixed by their respective precise positioning within the recesses 48, at least at their upper rim sections on their lid regions 40 relative to the packaging blank 14 and relative to the other beverage cans 34 or articles 12 in the article grouping 20, they can hardly deviate there.

However, since the packaging blanks 14 made of thin cardboard material normally used for the purpose described generally do not have a high degree of bending stiffness, initially, only the positions of the beverage cans 34 to one another are defined. However, this does not necessarily apply to their alignments in relation to the respective longitudinal central axes of the articles 12 or beverage cans 34, since these can be tilted relative to one another due to the flexibility of the packaging blank 14, wherein the lower regions, i.e., the base regions 36 of the beverage cans 34, can spread apart from one another.

In order to reliably prevent this undefined tilting of the beverage cans 34 within the composite of the article grouping 20 equipped with the packaging blank 14, the invention provides for secondary fixing device 30 which, like the primary fixing device 22, can equally be formed by the shaping and supplementary functional elements of the packaging blank 14 as its integral components.

The side surfaces 24 of the packaging blank 14 which are applied laterally to the shell surfaces 26 of the beverage cans 34 on two outer longitudinal sides of the arrangement or article grouping 20 form collar sections 52 so to speak, which are held there when the secondary fixing device 30 are used as intended and may in addition also be able to be slightly prestressed. The secondary fixing device 30 are activated by folding the strip sections 28 around the shell surfaces 26 of the articles 12 or beverage cans 34 located at the opposite narrow sides of the article grouping 20 and by fixing the at least slightly overlapping strip sections 28 to one another—for example, by bonding 54.

The bonding 54 indicated only schematically in FIGS. 1E and 1F by an interrupted line in the overlapping region of the strip sections 28 can be produced, for example, by prepared adhesive surfaces on the strip sections 28. Optionally, a sufficient amount of cold glue or hot glue can be applied to one of the strip sections 28 or to both overlapping regions of the superimposed strip sections 28, which can provide a firm mechanical connection between the strip sections 28.

However, the overlapping strip sections 28 can also be connected to one another in other ways—for example, by a clamping, a stamped connection, or the like.

In this way, the strapping sections 32, which hold the bundle or packaging unit 10 together and fix the positions and also the alignments of the beverage cans 34 to one another in the bundle unit, are formed from the strip sections 28, which are adhesively connected to one another.

The typical width of these strapping sections 32 formed from the strip sections 28 depends upon the requirements, in particular the desired stability of the bundle or the packaging unit 10. A very thin and flexible packaging blank 14 made of thick paper or thin cardboard will tend to require a collar section 52 that is pulled down further and slightly wider strapping sections 32 in order to be able to provide the desired mechanical stability of the packaging unit 10.

On the other hand, a sufficiently stable and mechanically resistant cardboard as packaging blank 14 will allow the width of the strapping sections 32 to be fixed at a value of approximately one quarter or less of the height of the cylindrical shell surfaces 26 of the beverage cans 34 held together in this way, as the variant in FIGS. 1A to 1F shows by way of example. There, the width of the strapping sections 32 is even less than one fifth of the respective height of the cylindrical shell surfaces 26 of the beverage cans 34.

The strip sections 28 of the variant of the packaging blank 14 according to FIG. 1A and FIG. 1C are in each instance of the same length, such that the packaging blank 14 is also configured to be mirror-symmetrical with respect to both the first main axis 42 and the second main axis 44. In principle, in alternative embodiment variants, the strip sections 28 can be configured in length configurations that differ from one another.

The schematic perspectival views of FIGS. 2A to 2D illustrate an embodiment variant of an application head 60 according to the invention with a total of four integrated application units 62 for the simultaneous and in particular synchronous handling of four article groupings 20, wherein each of the application units 62 is provided for equipping a corresponding one of the article groupings 20, shown by way of example in FIGS. 1A to 1F, with a flat packaging blank 14.

Figure 2A:
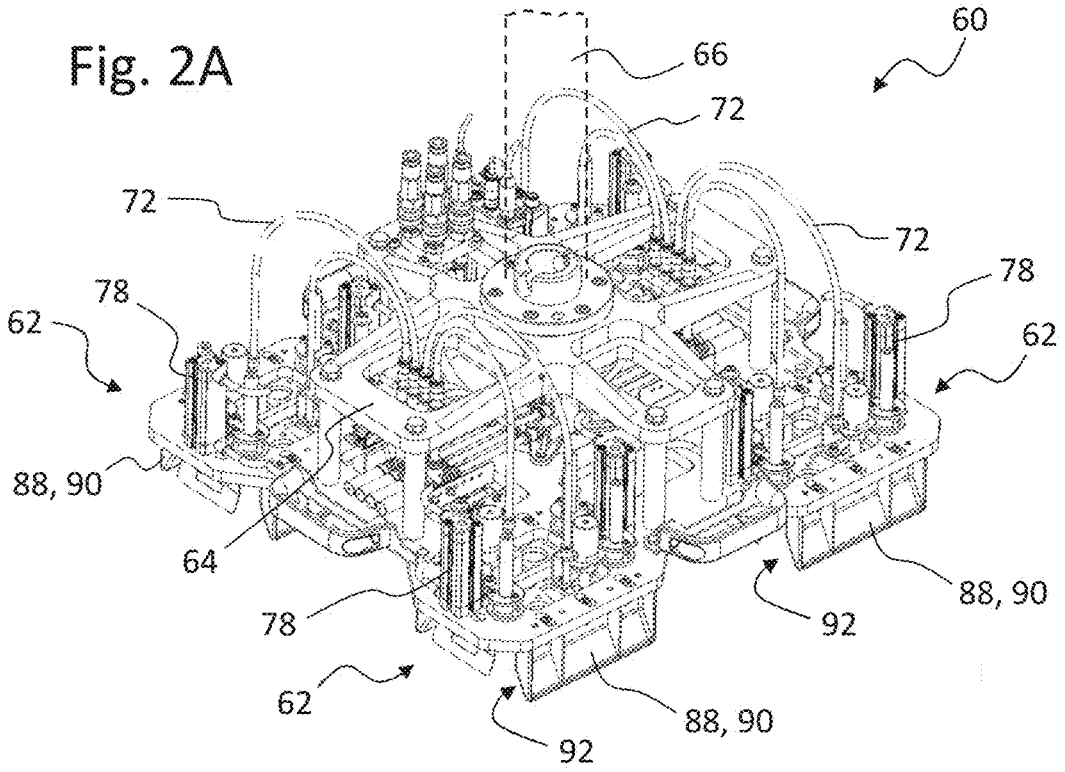
FIGS. 2A to 2D show different views of a variant embodiment of an application head according to the invention, equipped with four application units for equipping a total of four article groupings with packaging blanks.

As is particularly clear from FIG. 2A with its perspectival view obliquely from above of the application head 60, the total of four application units 62 are anchored to a support frame 64 which is rotatably suspended from a movable arm section 66. This arm section 66, of which only a vertical part is indicated in FIG. 2A by broken lines, can in particular enable mobility of the application head 60 within a defined movement space, which is not shown in more detail here. Thus, the vertical part of the arm section 66 indicated in FIG. 2A can be part of a cantilever arm that is movable within the movement space and may have joints that enable the arm section 66 to be raised and lowered together with the application head 60 suspended thereon.

The application head 60 equipped with the four application units 62 can be moved with the help of the movable boom arm or, if necessary, by a portal suspension (not shown here) or another type of suspension within its movement space between a supply (not shown here) or a provision location for the packaging blanks 14, which are flat and normally still unfolded, but are provided with the necessary cutouts and openings, and a provision location or a conveyor section with the article groupings 20 held ready there.

The four application units 62 anchored in defined positions and at defined distances from one another in a rectangular arrangement on the carrier frame 64 of the application head 60 require a corresponding arrangement of the four article groupings 20 held ready at the same defined distances from one another and in the same defined alignments, such that the four application units 62 can in each instance be positioned precisely above the suitably aligned article groupings 20.

On the arm section 66, which can be raised and lowered, the application head 60 with its four application units 62 and together with the packaging blanks 14 received there in each instance and held therein can be lowered after being positioned above the article groupings 20 or in a flowing movement after bringing together the article groupings 20 held ready in suitable positions and alignments.

As is illustrated in particular by the perspectival detail view of FIG. 2D, which shows one of the application units 62 obliquely from below without the packaging blank 14 held there, the picking up of the packaging blanks 14 from the supply stack or from a suitable and equipped provision location and their temporary holding in the corresponding application unit 62 can be carried out with the aid of suitable suction elements 68, of which a plurality are located in the application head 60 and which can each be subjected to negative pressure in order to pick up the flat packaging blanks 14.

FIGS. 2A to 2D each show two such suction elements 68 formed by suction punches 70 in each of the four application units 62, so that a total of eight such suction elements 68 or suction punches 70 are located in the application head 60. The suction elements 68 or suction punches 70 in each instance have negative pressure lines 72 for, in particular, controllable and/or disconnectable supply with negative pressure, which can be supplied to the negative pressure lines 72 via a central supply line in the arm section 66, which is not shown in more detail here.

Optionally, the suction elements 68 or suction punches 70, each equipped with separate negative pressure lines 72, can be controlled jointly or individually. To receive and hold the packaging blanks 14 on the lower side in the application head 60, the negative pressure on the suction elements 68 or suction punches 70 can preferably be activated and deactivated for dispensing the packaging blanks 14.

Thus, if the packaging blanks 14, after positioning over the article groupings 20 and/or after synchronization with the article groupings 20 conveyed, or conveyed further, e.g., on a horizontal conveyor, are to be placed on the article groupings 20 and, after lowering the application head 60, are to be pressed on and locked there, forming the primary fixing device 22 (cf. FIGS. 1A to 1F), it is expedient and necessary to deactivate the negative pressure applied to the suction elements 68 or suction punches 70, whereby the packaging blanks 14 held by two suction elements 68 or suction punches 70 can be released, and their previously temporarily maintained fixation in the application head 60 can be canceled.

As can be seen in particular in FIGS. 2C and 2D with their views from below at an angle onto the application units 62, the two suction elements 68 or suction punches 70 of each application unit 62 are located diagonally offset to one another and at practical distances from one another in order to be able to receive a flat packaging blank 14 from a stack with only two such suction elements 68 or suction punches 70 and hold it reliably until it is placed on the article grouping 20 provided for this purpose.

The release of the packaging blanks 14 and their respective latching onto the upper sides of the article groupings 20 provided for this purpose is supported by further components in the application head 60 or in its application units 62. Thus, in the variant embodiment shown of the application head 60, the formation of the primary fixing device 22 is supported by flat contact plates 74 which are movably arranged in the application units 62 and which can each be lowered perpendicularly to the surface of the packaging blanks 14 resting thereon and thus generally in the vertical direction relative to the application units 62, while at the same time the negative pressure of the suction elements 68 or suction punches 70 which hold the packaging blank 14 in the corresponding application unit 62 is deactivated.

As can be seen from FIGS. 2A to 2D, the contact plates 74 are dimensioned approximately according to the size and extent of the main surfaces 18 of the packaging blanks 14.

Since the contact plates 74 each have matching circular recesses 76 at the positions of the suction elements 68 or suction punches 70 anchored in a fixed position in the corresponding application unit 62 (cf. FIGS. 2C and 2D), each of the contact plates 72 together with the packaging blank 14 lying thereon (cf. FIG. 2B) can be lowered onto the upper side of the corresponding article grouping 20 and preferably pressed on there (cf. the perspectival side view of FIG. 2B), while the suction elements 68 or suction punches 70 extending through the corresponding recesses 76 of the contact plate 74 are without negative pressure, so that the packaging blank 14 can be released from there largely without resistance.

The contact plates 74, which are movable within a defined linear path, can be moved by motor between their end positions, i.e., raised or lowered, in particular by suitable linear guides and/or linear motors 78 relative to the corresponding application unit 62 of the application head 60. As FIGS. 2A to 2D each illustrate, each of the raisable and lowerable contact plates 74 can be suspended from two pneumatically actuated linear motors 78, wherein the linear motors 78 are each located on the opposite narrow sides of each contact plate 74. The linear motors 78 can optionally also be configured as electric motors.

Figure 2B:
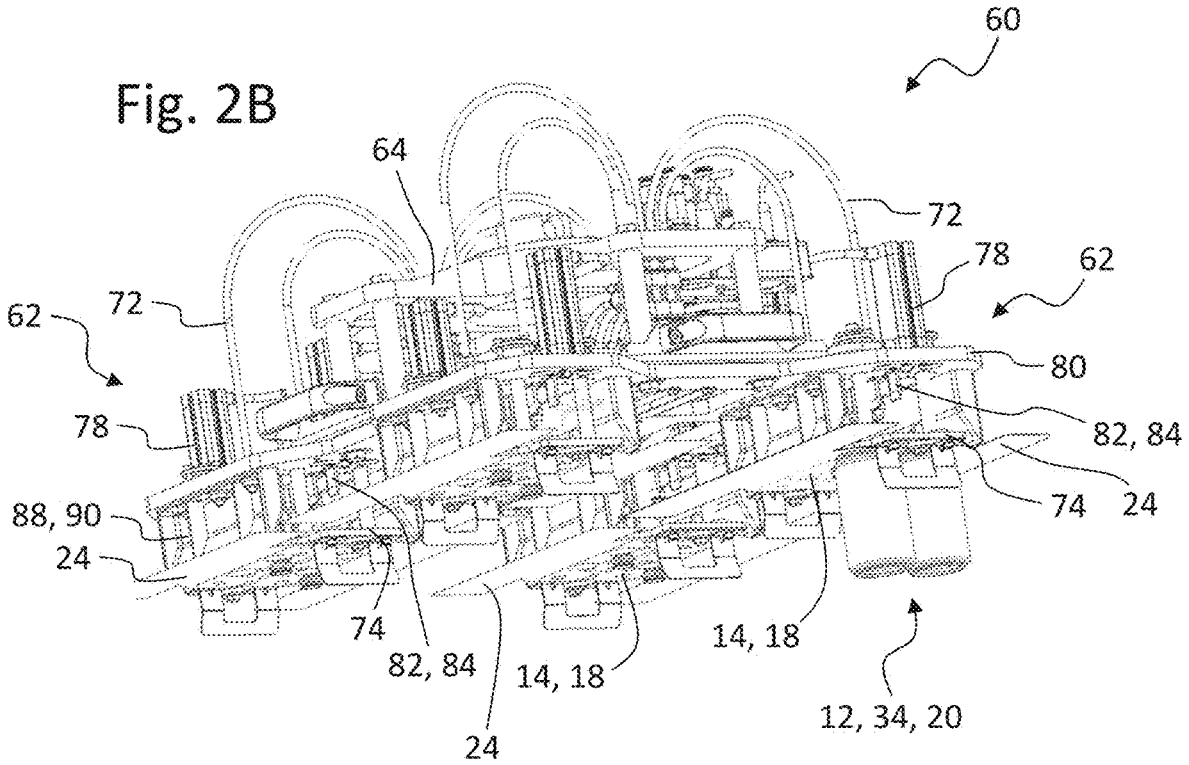

The schematic perspectival view of FIG. 2B shows the process phase of placing the still-unfolded packaging blanks 14 on the upper side of the article grouping 20. The negative pressure on the suction elements 68 or suction punches 70 is deactivated, and the contact plate 74 is completely lowered relative to the lower frame section 80 by the linear motors 78 anchored to a lower frame section 80. This lower frame section 80 forms a supporting element that receives the components of the total of four application units 62 and is firmly anchored to such upper carrier frame 64 in a position spaced apart from the upper carrier frame 64.

As already explained above with reference to FIGS. 1A to 1F, in the further course of the production of the packaging units 10 and by moving the contact plate 74 to its lower stop, the packaging blank 14 is connected or locked to the articles 12 of the article grouping 20, forming the primary fixing device 22. In this context, the main surface 18, which is placed on the top of the article grouping 20 and in particular is locked or otherwise fixed there, of the packaging blank 14 is deformed in its folding region 46 and pressed in between the adjacent rows of articles, wherein adjacent primary fixing device 22, together with the articles 12 held therein, are brought closer to one another, in particular until the adjacent articles 12 come into contact.

FIG. 2B does not show the horizontal distance A previously explained with reference to FIG. 1B, even if this distance A is preferably present between the adjacent rows of articles or cans shown, since such a distance is helpful for forming the folding region 46 by the shaping device arranged in the application unit 62 and for forming the packaging blank 14 in the desired and intended manner. This issue is particularly relevant for the slim or sleek cans shown here, which are to be processed into packaging units 10.

After the preferably simultaneous lowering of the total of four contact plates 74 together with the packaging blanks 14 lying on the underside thereof onto the top sides of the corresponding article groupings 20, and after the locking of the articles 12 or cans 34 with the packaging blank 14, which was defined above as producing the primary fixing device 22, the articles 12 or rows of articles of each grouping 20, which are preferably at least slightly spaced apart from one another in this process phase (distance A; cf. FIG. 1B), can be subjected to the further handling step described below, which provides for the V-shaped forming of the folding region 46 in the main surface 18 of the packaging blank 14, as already explained above, and the approach to each other of the rows of articles of the grouping 20 until they touch each other, so that the usual rectangular arrangement of the grouping 20 is produced, which also corresponds to the arrangement within the packaging units 10 to be completed later.

The V-shaped formed section of the packaging blank explained above and its pressing in between the previously spaced article rows is carried out by knife-like or blade-shaped shaping elements 82, also referred to here as folding blades 84 according to their function, and which are arranged in a fixed manner in the application units 62 of the application head. When the contact plate 74 is lowered, each of such folding blades 84 lies above the level of the contact plate 74 and is thus concealed by the latter, such that each of the folding blades 84 cannot become effective when the packaging blank 14 is pressed onto the upper side of the article grouping 20 and when the first fixing device 22 are formed at the same time.

FIG. 2B shows this process phase with the shaping elements 82 or folding blades 84 anchored in the lower frame section 80 and projecting vertically downwards, which are clearly spaced apart from the contact plates 74 when they are lowered.

The process phase immediately following the placement of the packaging blank 14 on the article grouping 20 provides for a lifting of the contact plates 74 after the production of the primary fixing device 22 and with the suction elements 68 or suction punches 70 expediently still deactivated, which, however, is not illustrated in this form in FIGS. 2A to 2D for the application units 62 acting upon the article groupings 20.

Figure 2C:
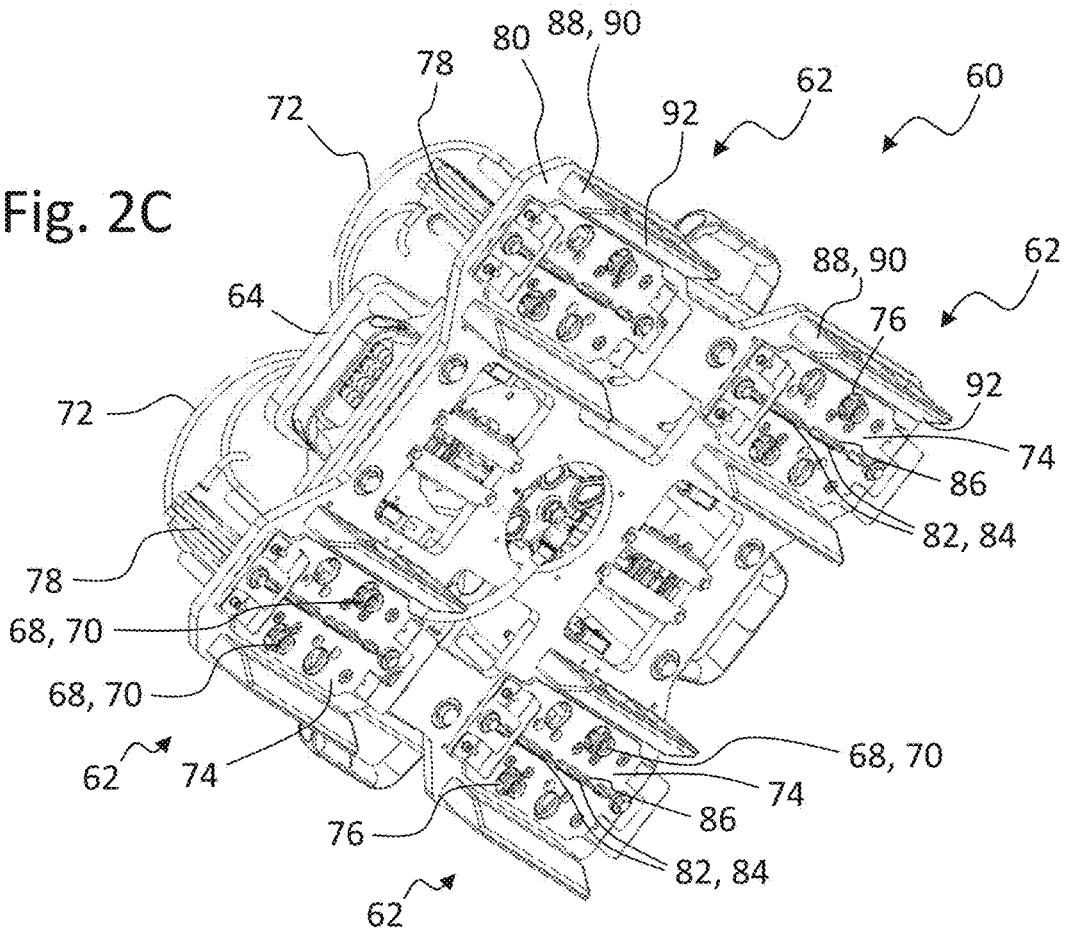
Figure 2D:
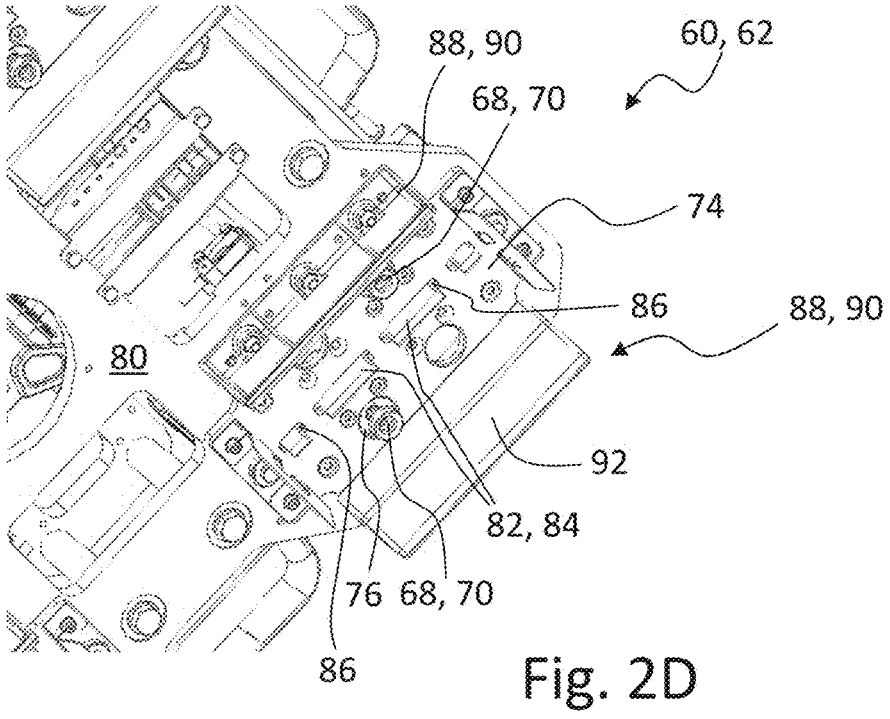

As can be seen from the perspectival view of FIG. 2C and from the perspectival detail view of FIG. 2D, the knife-like or blade-shaped shaping element 82 formed by the folding blade 84 extends through corresponding slot-like recesses 86 of the contact plate 74 when the contact plate 74 is raised against the lower frame section 80, so that the element projects downwards from the contact plate 74 when the contact plate 74 is raised and can become effective in the desired manner.

With the contact plates 74 raised against the lower frame section 80, the application head 60 can thus be lowered further until the folding blades 84 reach the packaging blanks 14 and press them down in a V-shape between the rows of articles in the corresponding folding regions 46 in the manner described, wherein the V-shaped deformed folding region 46 of the corresponding packaging blanks 14 is pressed in between the adjacent rows of articles.

Since the articles or rows of articles that were previously spaced apart are thereby pulled together, suitable guides are expedient in order to allow this bringing together to take place in a controlled manner. In principle, the pressing in of the V-shaped folding region 46 of the packaging blank 14 and lowering it between the articles or rows of articles is already sufficient to bring them closer together and to ensure that they are pulled or pushed towards each other.

The lowering movement of the entire application head 60 and the resulting synchronous feed movement of the four application units 62, in each instance with contact plates 74 raised to their upper stop against the lower frame section 80, enable the knife-like or blade-shaped shaping elements 82 or folding blades 84 exposed thereby to be pressed into the upper-side main surfaces 18 of the packaging blanks 14 along the respective folding regions 46 located there.

This lowering movement of the application head 60 is also used to fold the side surfaces 24, which are set off by creases on both long sides of the main surface 18 of the packaging blank 14, downwards at folding angles of approximately 90° each and to place them on the corresponding side surfaces 26 of the article grouping 20. In the embodiment variant shown, these folding movements are carried out by lateral folding elements 88 which are anchored in a stationary or rigid manner in the application head 60 and which become effective and can come into engagement with the packaging blank 14 as soon as the application head 60 is lowered in the direction of the upper side of the article groupings 20.

The folding elements 88 arranged on the lower frame section 80 of the respective application units 62 of the application head 60 on both longitudinal sides of each height-adjustable contact plate 74 and at small distances therefrom are formed by rigid tools in the exemplary embodiment shown, which are located in positions of the respective application units 62, where they can meet the side surfaces 24 of the flat packaging blank 14, which are defined by bending or folding edges and delimited in this way from the main surface 18, in order to be able to apply these to the opposite shell surfaces 26 of the article grouping 20. Thus, the folding elements 88 are formed by folding tools 90 that are anchored to the lower frame section 80 and project perpendicularly downwards from the lower side thereof and are configured in the form of strips that, due to their anchoring in the respective application unit 62, are fixed in their unchangeable relative positions with respect to the suction elements 68 and with respect to the contact plates 74 that can be raised and lowered in the application units 62.

A ramp-like bevel 92 on the folding tools 90 can support the previously spaced articles 12 or rows of articles being pushed together when the knife-like or blade-shaped shaping element 82 is activated. This is the case when the application head 60 is lowered, such that the lower end faces of the folding tools 90 are initially placed on the side faces 24 of the packaging blank 14. As soon as the folding process progresses by further lowering the application head 60, the side surfaces 24 of the packaging blank 18 that are bent downwards by the folding tools 90 slide along the ramp-like bevels 92 on the inner sides, facing the side surfaces 24, of the folding tools 90 until they are completely folded downwards and placed against the shell surfaces 26 of the corresponding article grouping 20.

In contrast, the vertical surfaces, which adjoin the ramp-like bevels 92, at the top, of the lateral folding elements 88 have an expedient spacing which corresponds approximately to the width of the two rows of articles of the article grouping 20 pushed together, wherein the previously existing distance A between the rows of articles (cf. FIG. 1B) is eliminated.

In a later method step, after the application head 60 has been lifted from the article groupings 20 provided with the packaging blanks 14, these groupings can preferably be subjected to further handling and/or treatment steps, with which further measures can be taken to complete the packaging units 10. Such steps can in particular be the further processing of the secondary fixing device 30 by folding over the strapping sections 32 and the gluing of overlapping and superimposed strip sections 28 (cf. in this regard FIGS. 1E and 1F).

Figure 2E:
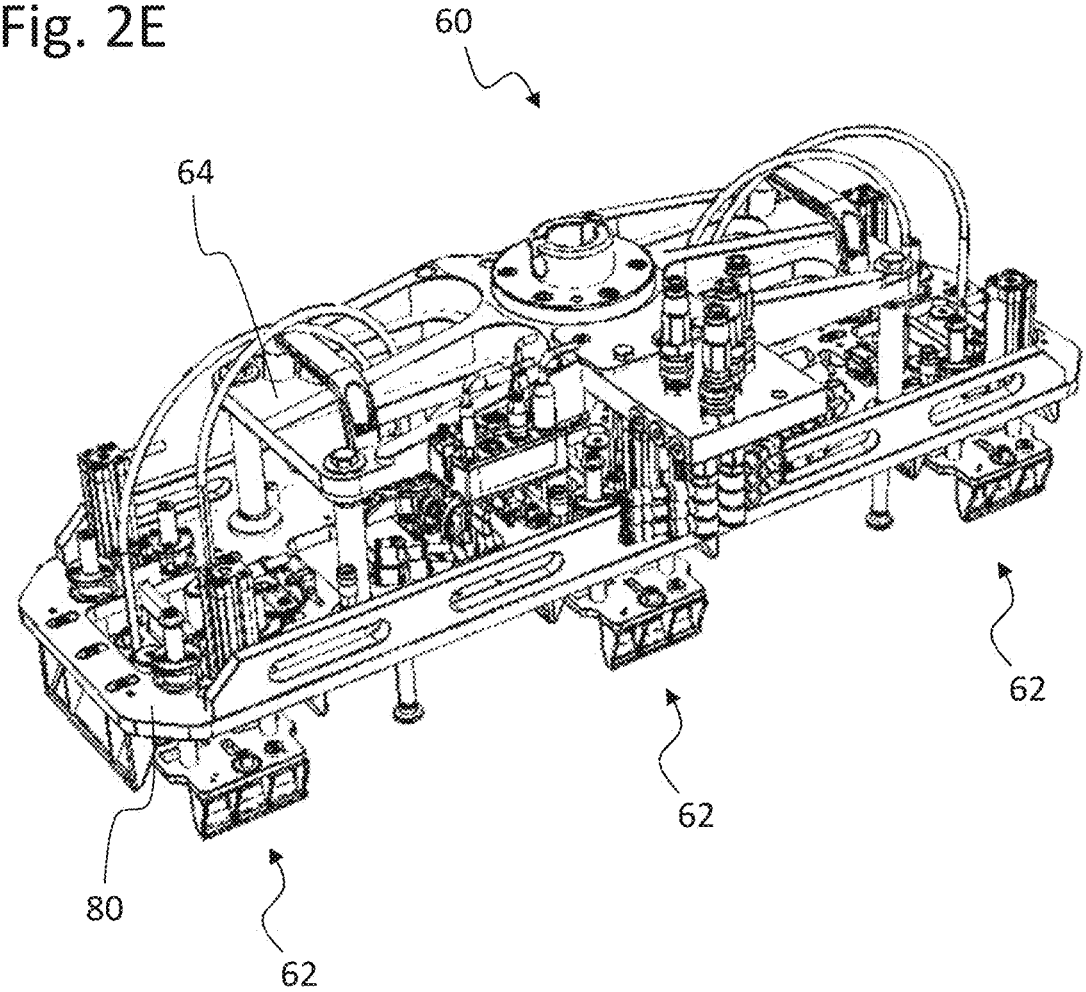
FIG. 2E shows a perspectival view of a further variant embodiment of the application head according to the invention, equipped with three application units for equipping a total of three article groupings with packaging blanks.

The perspectival view of FIG. 2E shows a further variant embodiment of the application head 60 according to the invention, which is equipped here with three application units 62 arranged next to one another and spaced apart from one another for equipping a total of three article groupings 20 with packaging blanks 14.

The support frame 64, which is rotatably held on a vertical arm section 66 (cf. FIG. 2A), as well as the frame section 80 anchored to the underside of the support frame 64 for receiving the three application units 62, is modified compared to the previously shown variant (FIGS. 2A to 2D), so that the three application units 62 are arranged next to one another in a row. The remaining structure and the mode of operation of the application units 62 preferably do not differ from the previously explained variant with the four application units 62 grouped in a rectangular arrangement in the application head 60.

Such an application head 60, as shown by way of example in FIG. 2E, is suitable for processing three article groupings 20 conveyed next to one another or for simultaneously processing three article groupings 20 conveyed one behind the other.

Figure 3:
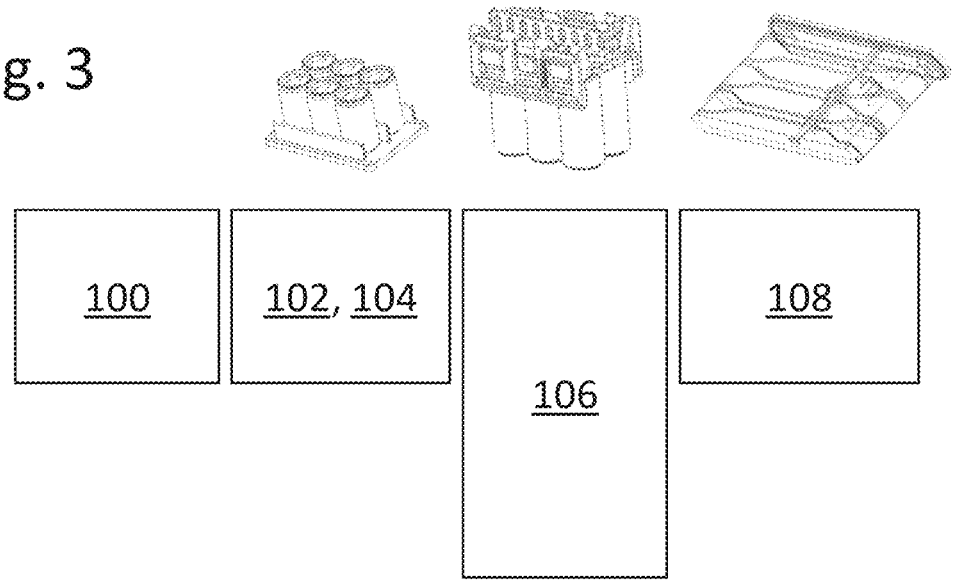
FIG. 3 shows a schematic block diagram to illustrate the method steps involved in the formation of packaging units.

The schematic flowchart of FIG. 3 is intended to illustrate, by way of example, successive method steps in the production of packaging units 10, which are formed from a plurality of articles 12, such as in particular beverage cans 34. These are first transferred from a mass flow into a multi-row transport flow in a single-part module 100, as shown in detail in FIG. 5. The further transport of the articles or beverage cans 34 can in particular be aisle-guided, which is to be indicated here in general by an aisle guide 102. Preferably, grouping also takes place in such aisle guide 102, such that a grouping module 104 can also be assigned to the aisle guide 102.

Within the grouping module 104, provision can be made in particular for the formation of the 3×2 rectangular arrangement of the article groupings 20 according to the previously shown embodiment (cf. FIGS. 1A to 1F) as well as for the spacing and arrangement of four such article groupings 20 corresponding to the dimensions and positioning of the application units 62 in the application head 60 (cf. FIGS. 2A to 2D).

In a subsequent application module 106, the application of the packaging blanks 14 takes place in the manner described above, in particular by the application head 60 shown as an example in FIGS. 2A to 2D, which means the production of the primary fixing device 22 by placing the packaging blanks 14 on top and locking them or otherwise connecting them to the articles 12 or beverage cans 34.

In a separate further step, the band sections or strip sections 28 can be connected to one another and formed into strapping sections 32, which means the production of the secondary fixing device 30 by folding, pre-tensioning, and fixing the overlapping strip sections 28 and forming them into the strapping sections 32 (cf. FIG. 1E and FIG. 1F). This forming can be carried out in particular in a so-called strapping module 108, which can be equipped, for example, with a folding element 88 or folding tool 90 (cf. FIGS. 2A to 2D) or with another tool or handling combination.

Figure 4:
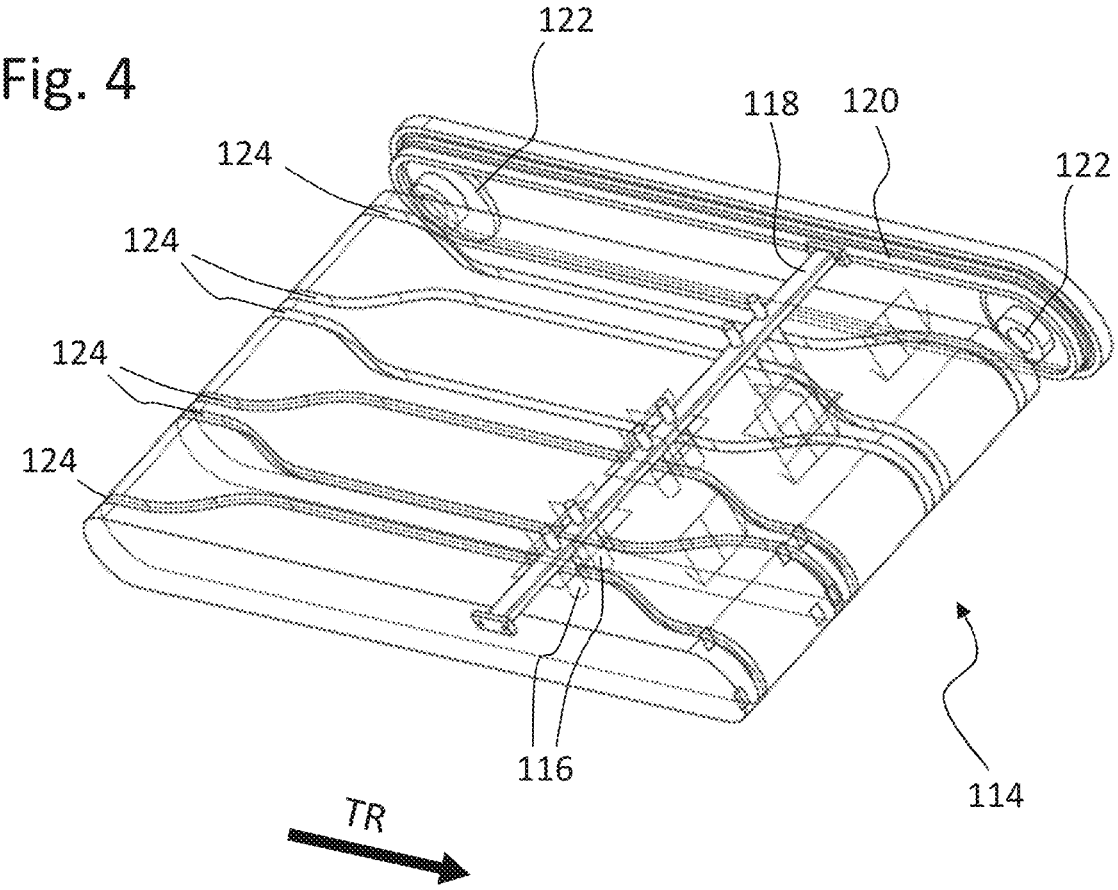
FIG. 4 shows a configuration for controlling folding devices that can be used in the formation of the packaging units.

Since the folding devices for producing the strapping sections 30 are no longer part of the application module 106 with the application head 60, FIG. 4 schematically shows a configuration for controlling folding devices that can be used in the formation of the packaging units 10 following the application module 106. This control configuration is therefore to be assigned to the strapping module 108 (cf. FIG. 3).

Thus, the schematic perspectival view of FIG. 4 shows a conceivable variant embodiment of a folding tool 114 together with its control elements for controlling the movement of a plurality of folding fingers 116, which can be used, for example, for folding and applying the strapping sections 28 to the front and rear end faces of the article groupings 20.

A transverse beam 118 running in a plane above the strip sections 28 to be folded over, which form the strapping sections 32 and thus the secondary fixing device 30 when bonded together or fixed to one another in the final state, is guided laterally in a circumferentially guided endless traction device 120 such as, for example, a circumferential chain or a belt. The endless traction device 120 are guided by two part guide wheels 122, at least one of which is motor-driven.

A total of three pairs of folding fingers 116 are held and mounted on the crossbeam 118 for a three-lane processing, shown here as an example, of article groupings 20 transported next to one another, which pairs extend downwards into a plane of movement of the article groupings 20 or the packaging units 10 to be completed and can contact the article groupings 20 or packaging units 10 when they are moved, by the crossbeam 118, along or opposite the transport direction TR of the article groupings 20 or packaging units 10.

Furthermore, the folding fingers 116 can be moved towards each other or away from each other in pairs, i.e., can be moved over defined adjustment paths transversely to the crossbeam 118, while the latter is moved by the endless traction device 120 in its defined plane of movement along or opposite the transport direction TR of the packaging units 10. Such transverse movement of the folding fingers 116 is controlled by guide slots 124, each of which comprises straight and parallel sections, in which the folding fingers 116 are spaced closer together, and other straight and parallel sections in which the folding fingers 116 are spaced further apart.

Such sections running parallel in pairs of the guide slots 124 are in each instance connected by inclined sections, in which the guide slots 124 move symmetrically away from one another or symmetrically towards one another. The folding movements required for folding over the strip sections 28 of the packaging blanks 14 can be generated with the circulation of the transverse beam 118 and the folding fingers 116 guided thereby in the correspondingly contoured guide slots 124.

FIG. 4, on the other hand, does not show any devices for producing the adhesive bonds 54 (cf. FIGS. 1E and 1F), which can result in the adhesive connection of the superimposed or overlapping regions of the strip sections 28.

Figure 5:
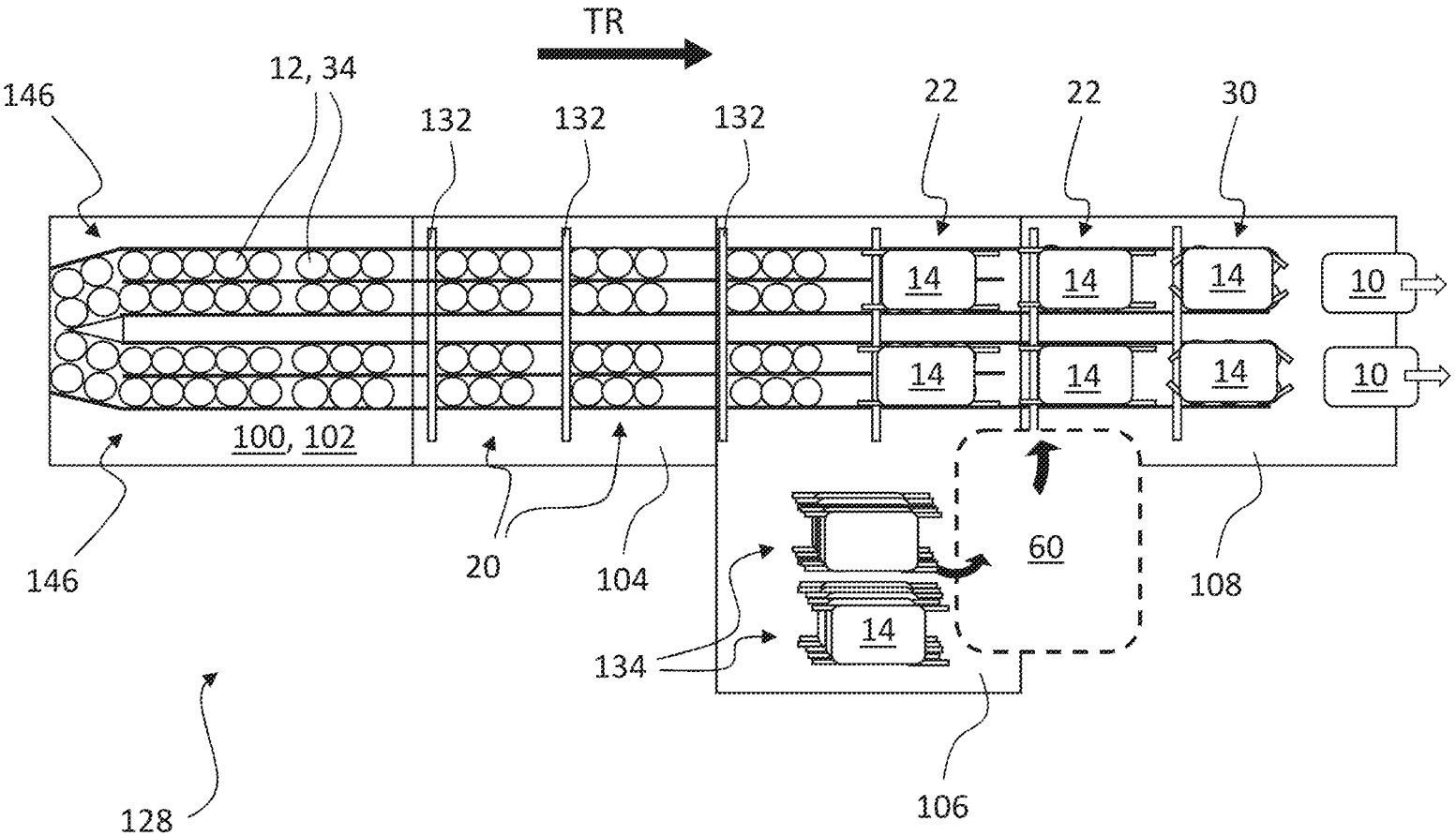
FIG. 5 shows a schematic plan view of a transport section in which packaging units can be formed and produced.

Finally, the schematic plan view of FIG. 5 shows a possible variant embodiment of a transport section 128, which can have the modules schematically indicated in FIG. 3 in a combined and successive form.

For example, FIG. 5 illustrates a first section that can be formed by the dividing module 100 (cf. in this regard also FIG. 3). There, the articles 12 or beverage cans 34 are conveyed in a total of four parallel lanes in the transport direction TR by a horizontal conveying device not described in detail here, which is why the dividing module 100 is also combined with the aisle guide 102. The aisle guiding 102 takes place in pairs, wherein in each instance two aisles run directly next to each other and to two spaced but parallel transport tracks 130.

The dividing module 100 and the doubled aisle guide 102 formed by the two parallel transport tracks 130 are followed in the transport direction TR (from left to right in FIG. 5) by the grouping module 104, where suitable dividing devices, which can be formed here by push rods or by other sliders 132, are used to group and divide the articles 12 or beverage cans 34 previously conveyed in uninterrupted succession into two parallel rows of three. As a result, the article arrangements or article groupings 20, consisting of a total of six articles 12 or beverage cans 34 grouped in a rectangular arrangement, are already formed in the grouping module 104, as has been explained multiple times previously.

These article groupings 20 are each suitably equipped, in the subsequent application module 106, with the packaging blanks 14 taken from a magazine 134 or otherwise supplied or provided, wherein the primary fixing device 22 are normally produced and formed in the application module 106. The application of the packaging blanks 14 to the article groupings 20 conveyed in the transport lanes 130 can be carried out, for example, by the application head 60 shown in FIGS. 2A to 2D.

In the subsequent strapping module 108, the secondary fixing device 30 are produced, in particular by producing the strapping sections 32 mentioned multiple times above. The packaging units 10 thus equipped with primary and secondary fixing device 22, 30 and thus completed can then be conveyed further in the transport direction TR, which is not shown in detail here, but is merely indicated by directional arrows on the packaging units 10 shown at the far right.

The following is given as a supplementary note to the above statements. If, in the context of the embodiment variants shown in the figures and their descriptions above, reference is also made often or also generally to "schematic" representations and views, this does not mean in any sense that the figure representations and their description are to be of subordinate importance with regard to the disclosure of the invention. A person skilled in the art is certainly able to derive sufficient information from the schematically and abstractly drawn representations that will make it easier for the person skilled in the art to understand the invention without being confused in any way by the drawn and possibly not exactly true-to-scale proportions of parts of the apparatuses, details thereof, or other drawn elements. Rather, the figures enable the person skilled in the art, as the reader, to derive a better understanding of the inventive idea—which has been formulated in more general and/or more abstract terms in the claims and in the general part of the description, at least with regard to some aspects—on the basis of the more specifically explained implementations of the method according to the invention and the more specifically explained structure of the device according to the invention.

The invention has been described with reference to a preferred embodiment. However, it is conceivable for a person skilled in the art that modifications or changes can be made to the invention without departing from the scope of protection of the following claims.

List of Reference Signs

| | |
|---|---|
| 10 | packaging unit, bundle |
| 12 | article |
| 14 | packaging blank |
| 16 | upper end face (article) |
| 18 | main surface (packaging blank) |
| 20 | article grouping, arrangement, article arrangement |
| 22 | primary fixing device, primary connecting device |
| 24 | side surface (packaging blank) |
| 26 | shell surface (article, article grouping) |
| 28 | strip section |
| 30 | secondary fixing device, secondary connecting device |
| 32 | strapping section |
| 34 | beverage can, can |
| 36 | base region, lower base region, can base |
| 38 | lower end face |
| 40 | lid region, upper lid region, can lid |
| 42 | first main axis, first horizontal main axis (article grouping) |
| 44 | second main axis, second horizontal main axis (article grouping) |
| 46 | folding region (packaging blank, main surface) |
| 48 | recess, slot-like recess |
| 50 | roof-shaped transition |
| 52 | collar section (packaging blank) |
| 54 | bonding (strip section) |
| 60 | application head |
| 62 | application unit |
| 64 | carrier frame (application head) |
| 66 | arm section |
| 68 | suction element |
| 70 | suction punch |
| 72 | negative pressure line |
| 74 | contact plate |
| 76 | recess, circular recess |
| 78 | linear motor, linear drive |
| 80 | lower frame section |
| 82 | shaping element, knife-like shaping element, blade-shaped shaping element |
| 84 | folding blade |
| 86 | recess, slot-like recess |

-continued

| List of Reference Signs | |
|---|---|
| 88 | lateral folding element |
| 90 | folding tool |
| 92 | ramp-like bevel |
| 100 | dividing module |
| 102 | aisle guide |
| 104 | grouping module |
| 106 | application module |
| 108 | strapping module |
| 114 | folding tool |
| 116 | folding fingers |
| 118 | transverse beam |
| 120 | endless traction device |
| 122 | guide wheel |
| 124 | guide slot |
| 128 | transport section |
| 130 | transport lane |
| 132 | slider |
| 134 | magazine |
| α | opening angle (of the reshaped folding region) |
| A | distance, horizontal distance |
| TR | transport direction |

The invention claimed is:

1. A controllable application head (60), comprising:

a receiving device for at least one packaging blank (14) that places the packaging blank (14) on an upper side of article grouping (20) of at least two articles (12), and at least one application unit (62) for producing a mechanical connection between the packaging blank (14) and the article grouping (20), wherein the receiving device comprises at least one suction device which can be subjected to a controllable negative pressure and which can be subjected to an increased negative pressure for receiving and holding the at least one packaging blank (14) and to a reduced negative pressure for releasing the at least one packaging blank (14), and wherein each of the at least one application unit (62) comprises folding elements (88) for folding over side surfaces (24) of the packaging blank (14) that project beyond an upper side of the article grouping (20) and for preparing a secondary fixing device (30) between the article grouping (20) and the packaging blank (14).

2. The controllable application head of claim 1, wherein the controllable application head is movable within a movement space between a supply or provision area for a plurality of packaging blanks (14) and a location of each of the article groupings (20) to be treated.

3. The controllable application head claim 1, wherein each of the at least one application unit (62) is comprises:

a contact plate (74), that is vertically movable between two end positions, and at least one controllable suction element (68) for the negative-pressure-controlled holding or releasing of the at least one packaging blank (14).

4. The controllable application head of claim 3, wherein each of the at least one application unit (62) comprises a shaping element (82) for deforming a defined folding region (46) of the at least one packaging blank (14) placed on an article grouping (20).

5. The controllable application head of claim 4, wherein the movable contact plate (74), the suction elements (68), the folding elements (88), and the shaping element (82) of each application unit (62) can each carry out, in coordination with each other, forming the primary fixing device (22) and at least preparation of the secondary fixing device (30).

6. The controllable application head of claim 4, wherein the shaping element (82) forms primary fixing device (22) for producing mechanical connections between the articles (12) and the packaging blank (14).

7. The controllable application head of claim 1 comprising at least two application units (62) for the substantially synchronous treatment of two separate article groupings (20) and for equipping each of them with packaging blanks (14).

8. A method for producing packaging units (10) of at least two articles (12) held together by at least one packaging blank (14), comprising:

transferring a flat packaging blank (14), from a supply, by an application head (60) to an article grouping (20) held ready, applying the packaging blank (14) to an upper end face of the article grouping (20), producing a mechanical connection between the packaging blank (14) and the article grouping (20), with at least one application unit (62) comprising folding elements (88), folding over at least one foldable portion (24) of the packaging blank (14), that projects beyond an upper side of the article grouping (20) and for placing it the at least one foldable portion (24) against a side surface (26) of the article grouping (20), lifting the application head (60) from the article grouping (20), and removing the application head (60) from the article grouping (14).

9. The method of claim 8, further comprising positioning the application head (60), together with the packaging blank (14) held therein, at a vertical distance above the article grouping (20), which is stationary or is in a conveying movement.

10. The method of claim 9, further comprising moving the application head (60) within a movement space between a supply or provision location for the flat packaging blanks (14) and a provision location or a conveyor section with the article grouping (20) located there.

11. The method of claim 10, further comprising lowering the application head (60) as a whole, together with the packaging blank (14) held therein, onto the upper side of the article grouping (20), wherein the packaging blank (14) is applied thereto.

12. The method of claim 11, wherein the application head (60) comprises at least two modular application units (62), arranged next to each other within an application head (60), and further comprising processing, in parallel, two article groupings (20) of the same type and equipping them with packaging blanks (14).

13. The method of claim 12, wherein the applying step comprises lowering a flat contact plate (74) in each application unit (62), while at the same time, deactivating a negative pressure on suction elements (68) holding the packaging blank (14) in the corresponding application unit (62) or lowering the contact plate (74) relative to the suction elements (68) that are stationary in each application unit (62), whereby the packaging blank (14) is, in each instance, distanced from the suction elements (68) and released.

14. The method of claim 12, further comprising pressing the packaging blank (14) at least some distance between adjacent articles (12) of the article grouping (20) or between adjacent article rows of the article grouping (20), wherein this pressing, by a shaping element (82) deforms a folding region (46) of the packaging blank (14), wherein the shaping element (82) is arranged in a stationary manner in each application unit (62), wherein the shaping element (82) is covered by the contact plate (74) when the contact plate is lowered and which projects from an underside of the contact plate (74) by raising the contact plate (74) and, when the application head (60) is lowered, pushes the folding region (46) of the packaging blank (14) downwards between the articles (12) or article rows.

15. The method of claim 14, further comprising, in connection with or simultaneously with the lowering of the shaping element (82), wherein the lateral folding elements (88), arranged in a fixed position in each application unit (62) act upon the packaging blank (14) and fold side surfaces (24), projecting laterally beyond an upper side of the article grouping (20), of the packaging blank (14), and fold the side surfaces (24) downwards by a folding angle of approximately 90 degrees and place them against the side surfaces (26) of the article grouping (20).

16. A packaging apparatus for producing packaging units (10), comprising at least two articles (12), which at least two articles (12) are held together by at least one packaging blank (14), and which packaging apparatus at least comprises:

a conveyor, a transport section (128), or a provision position for conveying grouped articles (12) or for providing the grouped articles (12), an application device for equipping the article groupings (20) with at least one packaging blank (14) each, wherein the application device comprises at least one controllable application head (60) movable within a defined movement space, wherein the application head (60) is capable of equipping at least one article grouping (20), located within the movement space or moving there, with a packaging blank (14) and applying this blank to the article grouping (20), wherein the application head (60) comprises controllable devices for receiving, holding, and releasing the packaging blanks (14), and wherein the application head (60) comprises controllable tools for producing a mechanical connection between each article grouping (20) and the packaging blank (14) applied thereto, and wherein one controllable tool comprises folding elements (88) for folding over at least one foldable portion (24) of the packaging blank (14), that projects beyond an upper side of the article grouping (20), of the packaging blank (14) and for placing the at least on foldable portion against a side surface (26) of the article grouping (20).

17. The packaging apparatus of claim 16, wherein at least some of the mechanical connections between each article grouping (20) and the packaging blank (14) are produced by a shaping element (82).

* * * * *